US008335339B2

(12) United States Patent
Tagami et al.

(10) Patent No.: US 8,335,339 B2
(45) Date of Patent: Dec. 18, 2012

(54) SPEAKER UNIT AND SPEAKER APPARATUS

(75) Inventors: Takahisa Tagami, Kanagawa (JP); Emiko Ikeda, Tokyo (JP)

(73) Assignee: Sony Corporation, Tokyo (JP)

( * ) Notice: Subject to any disclaimer, the term of this patent is extended or adjusted under 35 U.S.C. 154(b) by 1366 days.

(21) Appl. No.: 12/009,908

(22) Filed: Jan. 23, 2008

(65) Prior Publication Data

US 2008/0205686 A1 Aug. 28, 2008

(30) Foreign Application Priority Data

Jan. 29, 2007 (JP) ..... 2007-018274
Mar. 6, 2007 (JP) ..... 2007-056299

(51) Int. Cl.
*H04R 1/00* (2006.01)

(52) U.S. Cl. ..... 381/413

(58) Field of Classification Search ..... 381/413, 381/415, 419
See application file for complete search history.

(56) References Cited

U.S. PATENT DOCUMENTS

| | | | | |
|---|---|---|---|---|
| 4,118,605 | A | 10/1978 | Kobayashi | |
| 4,138,593 | A * | 2/1979 | Hasselbach et al. | 381/409 |
| 4,303,806 | A * | 12/1981 | Thiele | 381/410 |
| 7,306,073 | B2 | 12/2007 | Frasl | |

FOREIGN PATENT DOCUMENTS

| | | | |
|---|---|---|---|
| EP | 1 455 553 | A | 9/2004 |
| GB | 2 182 823 | A | 5/1987 |
| JP | 57-021200 | A | 2/1982 |
| JP | 59-042691 | U | 3/1984 |
| JP | 59-042693 | U | 3/1984 |
| JP | 59-139795 | A | 8/1984 |
| JP | 62-158996 | U | 10/1987 |
| JP | 03-240399 | A | 10/1991 |
| JP | 06-014394 | A | 1/1994 |
| JP | 06-041298 | U | 2/1994 |
| JP | 08-223678 | A | 8/1996 |
| JP | 10-094090 | A | 4/1998 |
| JP | 10-164691 | A | 6/1998 |
| JP | 10-174193 | A | 6/1998 |
| JP | 2001-036989 | A | 2/2001 |
| JP | 2001-054191 | A | 2/2001 |
| JP | 2001-197591 | A | 7/2001 |
| JP | 2002-176691 | A | 6/2002 |
| JP | 2002-176692 | A | 6/2002 |
| JP | 2002-176693 | A | 6/2002 |
| JP | 2002-218585 | A | 8/2002 |

(Continued)

*Primary Examiner* — Alexander Ghyka
*Assistant Examiner* — Reema Patel
(74) *Attorney, Agent, or Firm* — Wolf, Greenfield & Sacks, P.C.

(57) ABSTRACT

To propose a speaker unit and a speaker apparatus enabling to improve the strength of a voice coil bobbin and sound output in high quality with a simple structure, there are provided that a magnetic circuit forming a magnetic gap in slit form, a frame for storing and holding the magnetic circuit, a diaphragm attached to be vibratable to the frame, a flat-type voice coil bobbin disposed so as to pass through the almost center of the magnetic gap, in that its one end is combined with the diaphragm, a voice coil is adhered to its surface, and convex and concave parts for improving the strength of the diaphragm in the vibrating direction are formed on the surface, and a damper attached to the frame to support the other end of the flat-type voice coil bobbin.

19 Claims, 26 Drawing Sheets

FOREIGN PATENT DOCUMENTS

| | | | |
|---|---|---|---|
| JP | 2002-223495 | A | 8/2002 |
| JP | 2002-223496 | A | 8/2002 |
| JP | 2002-262388 | A | 9/2002 |
| JP | 2003-047089 | A | 2/2003 |
| JP | 2003-339098 | A | 11/2003 |
| JP | 2005-236533 | A | 9/2005 |
| JP | 2006-507729 | A | 3/2006 |
| JP | 2006-093804 | A | 4/2006 |

* cited by examiner

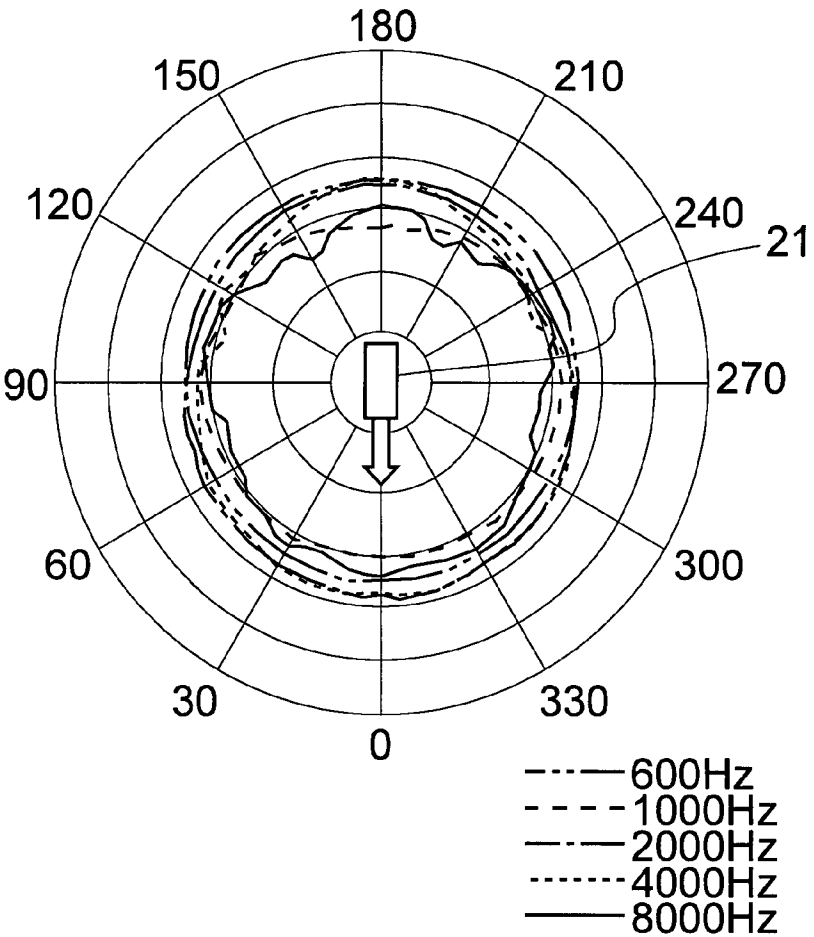
FIG. 17B SLIM-TYPE SPEAKER UNIT
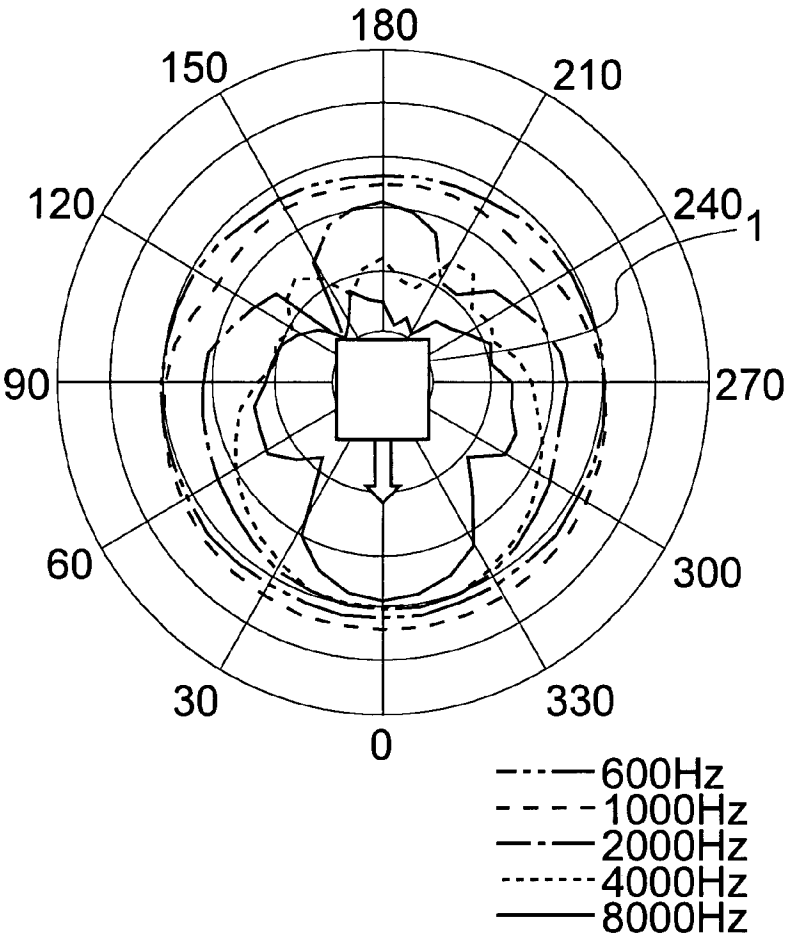
FIG. 17A CONVENTIONAL SPEAKER UNIT (RELATED ART)

SINGLE STRAIGHT GAP MAGNETIC CIRCUIT

TWIN STRAIGHT GAP MAGNETIC CIRCUIT

SPEAKER UNIT AND SPEAKER APPARATUS

CROSS REFERENCE TO RELATED APPLICATION

The present invention contains subject matter related to Japanese Patent Applications JP 2007-018274, JP 2007-056299 filed in the Japanese Patent Office on Jan. 29, 2007, Mar. 6, 2007, the entire contents of which being incorporated herein by reference.

BACKGROUND OF THE INVENTION

1. Field of the Invention

The present invention relates to a speaker unit and a speaker apparatus, and is applicable to a so-called slim-type speaker, for example.

2. Description of the Related Art

As shown in FIG. 1, a common speaker unit 1 has a speaker diaphragm 2 in an almost conic shape in that the top is opened. The outer circumference part of the speaker diaphragm 2 is supported by a frame 3 via an edge 4. On the other hand, the opening part of the inner circumference of the speaker diaphragm 2 is supported by a damper 5 attached to the frame 3. Thereby, the speaker diaphragm 2 is attached to the frame 3 freely movably in the backward and forward direction.

The speaker diaphragm 2 is fixed to a cylindrical voice coil bobbin 6 on which a voice coil 7 made of a lead wire is wounded at the lower side of its opening part, and is attached in the state where a hemispherical head cap 2A projects in the widely opening direction of the speaker diaphragm 2 so as to cover the opening part at the upper side of the opening part. Thereby, transform in the diameter direction of the above speaker diaphragm 2 and entry of dust or the like is prevented.

In the speaker unit 1, a magnetic circuit part 13 for vibrating the speaker diaphragm 2 back and forth is fixedly attached on the bottom side of the frame 3. This magnetic circuit part 13 has a yoke 10 in a disk shape on that a cylindrical pole piece 10A is planted up from the center. A magnet 9 in a ring shape is fixed as surrounding the top outer circumference of the above yoke 10, and a plate 8 in a ring shape is fixed as layered on the magnet 9.

In the speaker unit 1, if the magnetic circuit part 13 is attached to the frame 3 as a result that the top of this plate 8 and the bottom of the frame 3 are fixed, the voice coil bobbin 6 on which the voice coil 7 is wounded is held as surrounded in the state of being untouched in a magnetic gap g1 formed between the pole piece 10A and the plate 8.

Thus, in the speaker unit 1, if electromagnetic force is supplied to the voice coil 7 of the magnetic circuit part 13 by apply current based on an audio signal supplied from the outside via a terminal 12 and a flexible wire (that is generally called a "kinshisen" in Japanese) 11, the above voice coil 7 is attracted or repelled to the magnet 9. Thereby, the speaker diaphragm 2 vibrates back and forth, and a sound wave corresponding to the audio signal is generated.

By the way, in recent years, further slimming a speaker unit 1 has been desired, and a so-called slim-type speaker unit having a configuration that a thin diaphragm is combined with the end part of a voice coil bobbin having the form of a thin plate, not the aforementioned speaker diaphragm 2 in an almost conic shape in the speaker unit 1, has been proposed (see Japanese Patent Laid-Open No. 2002-223495, for example).

SUMMARY OF THE INVENTION

In the slim-type speaker unit shown in the JP 2002-223495, there has been a problem that although it has a configuration that a convex part of the voice coil bobbin is combined by passing through a damper having a through hole, and combining strength of the voice coil bobbin and the damper is improved, the strength of the voice coil bobbin itself to the driving direction of the diaphragm is weak, and it causes a deterioration in sound quality.

In view of the foregoing, it is desirable to provide a speaker unit enabling to improve the strength of a voice coil bobbin and sound output in high quality with a simple structure, and a speaker apparatus using that.

Note that, the term "voice coil bobbin" usually often means a cylindrical one. However, in the description of the present application, also plane one is called "bobbin" by following common cases.

According to an embodiment of the present invention, there are provided a magnetic circuit forming a magnetic gap in a slit shape, a frame for storing and holding the above magnetic circuit, a diaphragm attached to be vibratable to the above frame, a flat-type voice coil bobbin disposed so as to pass through the almost center of said magnetic gap, in that its one end is combined with the diaphragm, a voice coil is adhered to its surface, and convex and concave parts for improving the strength of the diaphragm in the vibrating direction are formed on said surface, and a damper attached to the frame to support the other end of the above flat-type voice coil bobbin.

Thereby, in a speaker unit, the strength of the flat-type voice coil bobbin when in driving the diaphragm in the vibrating direction is reinforced by the convex and concave parts, and the diaphragm can be vibrated linearly to drive force. Thus, high quality sounds can be outputted.

Further, according to an embodiment of the present invention, there are provided a speaker unit that includes a magnetic circuit forming a magnetic gap in a slit shape, a frame for storing and holding the above magnetic circuit, a diaphragm attached to be vibratable to the above frame, a flat-type voice coil bobbin disposed so as to pass through the almost center of the magnetic gap, and in that its one end is combined with the diaphragm, a voice coil is adhered to its surface, and convex and concave parts for improving strength in the vibrating direction of the diaphragm are formed on the surface, and a damper attached to the frame to support the other end of the above flat-type voice coil bobbin, and a housing for storing the above speaker unit.

Thereby, in a speaker apparatus, when in driving the diaphragm of the speaker unit stored in the housing in the vibrating direction, the strength of the flat-type voice coil bobbin is reinforced by the convex and concave parts, and the diaphragm can be vibrated linearly to drive force. Thus, high quality sounds can be outputted.

The nature, principle and utility of the present invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 17A and 17B are schematic diagrams showing directional characteristics;

DETAILED DESCRIPTION OF THE EMBODIMENT

Preferred embodiments of the present invention will be described with reference to the accompanying drawings.

(1) Overall Configuration of Speaker Apparatus

Figure 1:
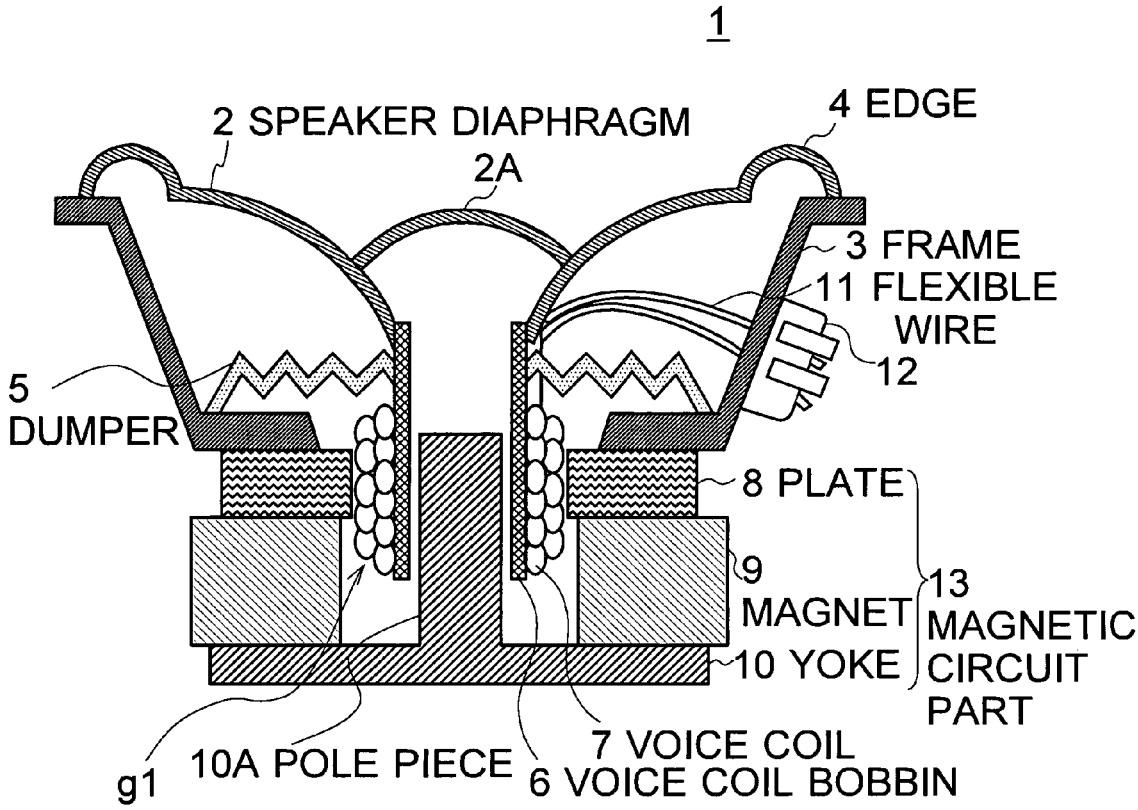
FIG. 1 (RELATED ART)
FIG. 1 is a schematic sectional view showing the sectional configuration of a conventional common speaker unit.
Figure 2:
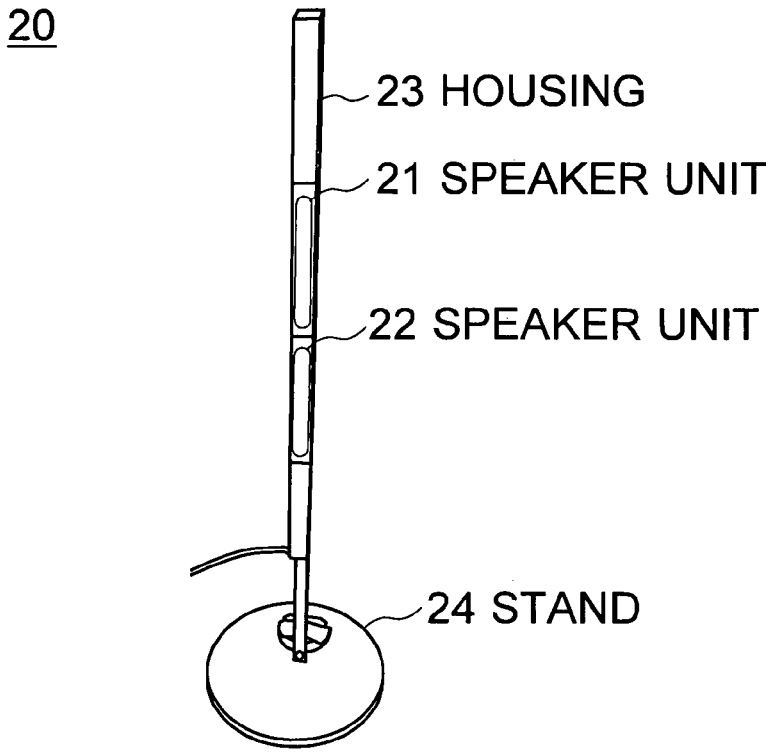
FIG. 2 is a schematic perspective view showing the overall configuration of a speaker apparatus of an embodiment of the present invention.

As shown in FIG. 2, the reference numeral 20 shows a speaker apparatus as a whole having a configuration that slim-type speaker units 21 and 22 according to an embodiment of the present invention are stored in an oblong housing 23 in the state where they are vertically aligned to make the whole width as a whole as narrow as possible. The housing 23 is attached to a stand 24.

Figures 3A, 3B:
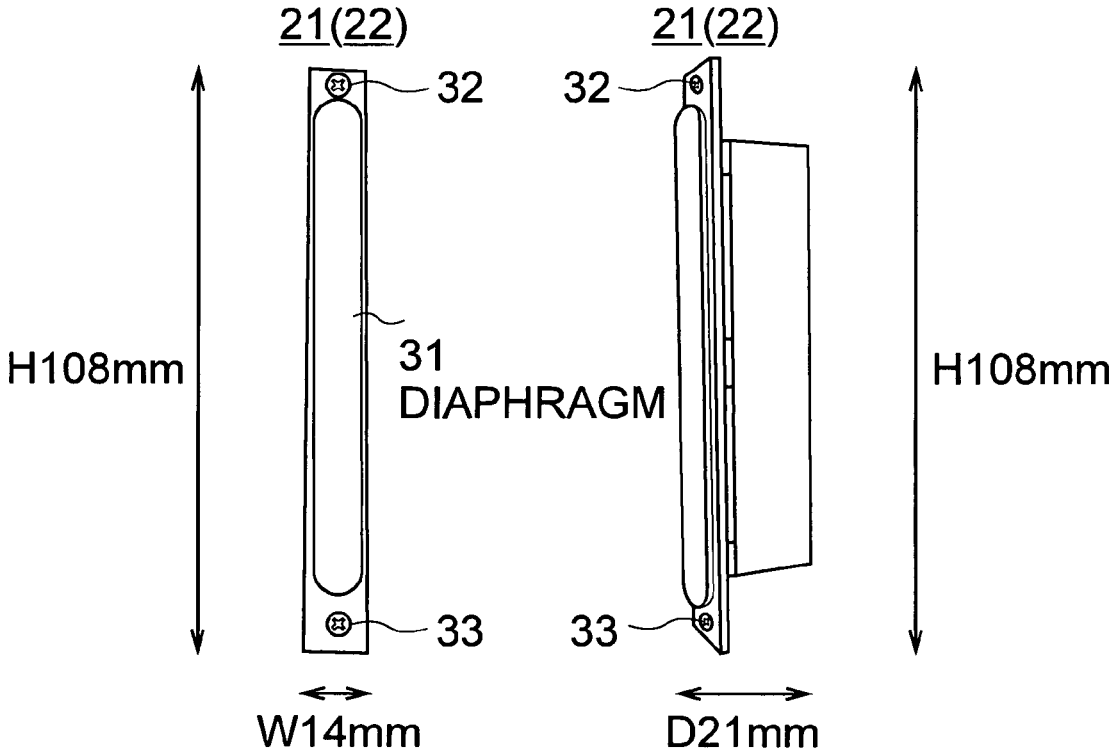
FIGS. 3A and 3B are schematic perspective views showing the size of a slim-type speaker unit.

As shown in FIGS. 3A and 3B, the size of the slim-type speaker units 21 and 22 is that the width is 14 mm, the height is 108 mm, and the depth is 21 mm. They are attached to the housing 23 with screws 32 and 33 disposed on/under a diaphragm 31.

(2) Configuration of Speaker Unit

Next, the configuration of the slim-type speaker units 21 and 22 will be described. However, because both have a common configuration, only the configuration of the speaker unit 21 will be described here, and a description of the configuration of the speaker unit 22 will be omitted, for convenience.

Figure 4:
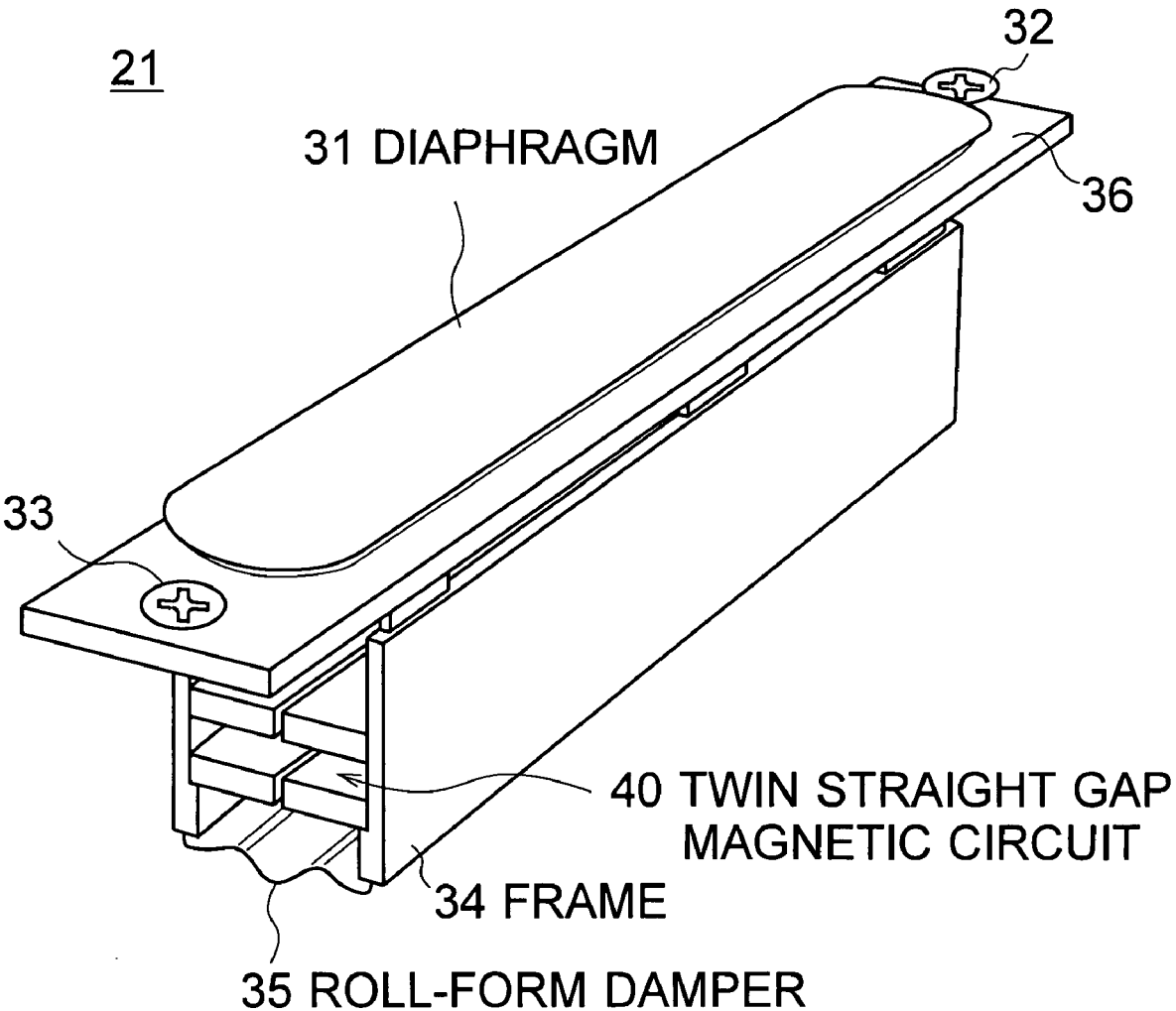
FIG. 4 is a schematic perspective view showing the overall configuration of the slim-type speaker unit.

As shown in FIG. 4, in the speaker unit 21, the diaphragm 31 is attached to a baffle panel 36 having a hole (not shown) that the whole is much smaller than the long and narrow diaphragm 31 formed at the center part, in vibratable in the backward and forward direction, and also a twin straight gap magnetic circuit 40 is disposed inside a frame 34 provided under the baffle panel 36.

Figure 5:
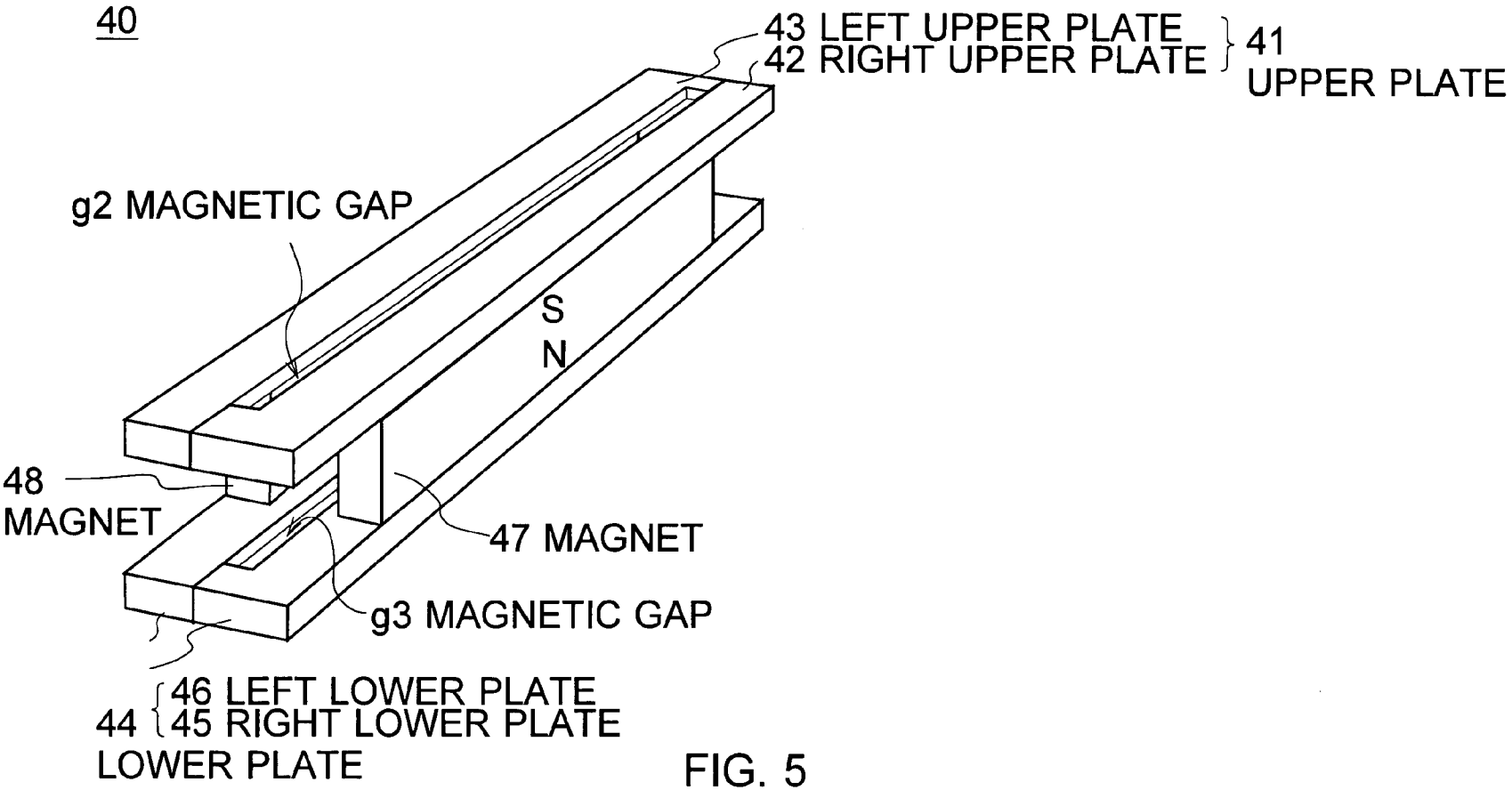
FIG. 5 is a schematic perspective view showing a twin straight gap magnetic circuit.

As shown in FIG. 5, in the twin straight gap magnetic circuit 40, for example neogium magnets that the maximum energy product is high (hereinafter, this is simply referred to as a magnet) 47 and 48 are attached to between an upper plate 41 and a lower plate 44 in a parallel state apart for a predetermined distance, so that necessary magnetic flux density can be efficiently obtained by the thin small magnets 47 and 48. In this connection, the "maximum energy product" is a unit representing performance of a magnet that the product of residual magnetic flux density (Br) and coercivity (HC) becomes its maximum.

In this twin straight gap magnetic circuit 40, a gap in the form of a slit formed between a right upper plate 42 and a left upper plate 43 in the upper plate 41 is used as a magnetic gap g2 by the magnets 47 and 48, and also a gap in the form of a slit formed between a right lower plate 45 and a left lower plate 46 in the lower plate 44 is used as a magnetic gap g3.

Figure 6:
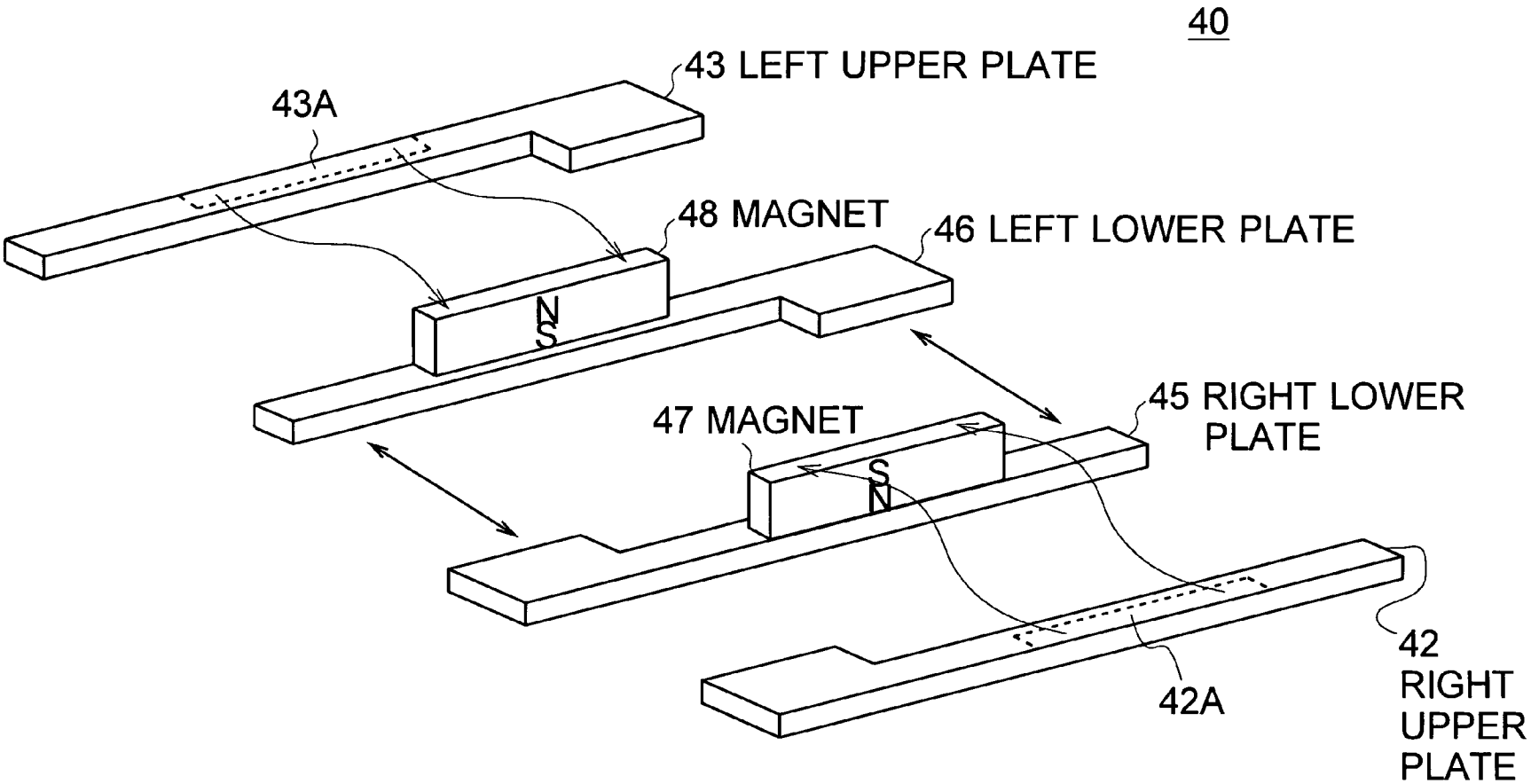
FIG. 6 is a schematic perspective view showing the configuration of the twin straight gap magnetic circuit.

Practically, as shown in FIG. 6, the magnet 47 is fixed at a predetermined position on the right lower plate 45 in almost L-shape, and magnetizing is made on the magnet 47 in the state where the right upper plate 42 having the same size and form as the right lower plate 45 is fixed so as to put it over the other (in this case, the upper side is the S pole, and the lower side is the N pole).

On the other hand, a magnet 48 is fixed as facing to the magnet 47 of the right lower plate 45 at a predetermined position on the left lower plate 46 in almost L-shape, and magnetizing is made on the magnet 48 in the state where the left upper plate 43 having the same size and shape as the left lower plate 46 is fixed so as to put it over the other (in this case, the upper side is the N pole, and the lower side is the S pole).

In the state, the side surface of the right lower plate 45 and the side surface of the left lower plate 46 are adhered, and the side surface of the right upper plate 42 and the side surface of the left upper plate 43 are adhered. Thereby, as shown in FIG. 5, the twin straight gap magnetic circuit 40 (FIG. 5) having the magnetic gap g2 in that magnetic flux is flown from the left upper plate 43 to the right upper plate 42 and the magnetic gap g3 in that magnetic flux is flown from the right lower plate 45 to the left lower plate 46 is formed.

That is, in the twin straight gap magnetic circuit 40, after magnetizing is made in the state where the right lower plate 45, the magnet 47 and the right upper plate 42 are united in one body, and magnetizing is made in the state where the left lower plate 46, the magnet 48 and the left upper plate 43 are united in one body, both are adhered. As a result, the magnetic gaps g2 and g3 in the form of slit are formed.

In the twin straight gap magnetic circuit 40, the magnetizing direction of the left lower plate 46 and the left upper plate 43 and the magnetizing direction of the right lower plate 45 and the right upper plate 42 are opposite as the above. Therefore, Mass productivity is vastly improved by forming it as described above in that the left side and the right side are respectively magnetized, and then they are combined.

In this connection, in addition to that the upper and lower parts of the right upper plate 42 and the right lower plate 45, and the upper and lower parts of the left upper plate 43 and the left lower plate 46 mutually have the same size and shape, also the right upper plate 42 and the left upper plate 43, and the right lower plate 45 and the left lower plate 46 mutually have the same size and shape. Therefore, commonality and versatility as parts are vastly improved.

Figure 7:
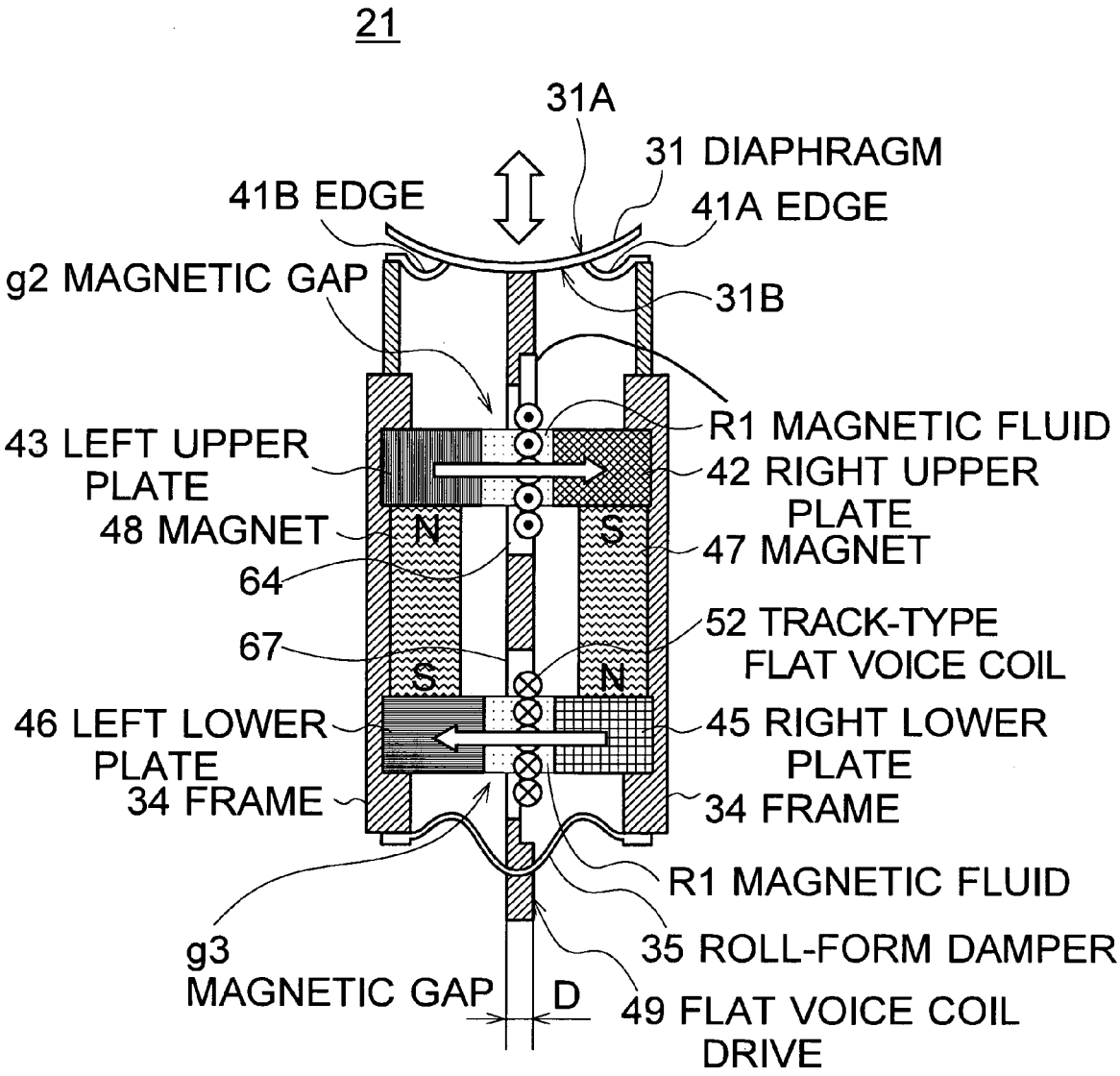
FIG. 7 is a schematic sectional view showing the sectional configuration of the slim-type speaker unit.

In the slim-type speaker unit 21 using such twin straight gap magnetic circuit 40, as shown in FIG. 7, as its sectional configuration, a flat voice coil drive 49 is disposed between the magnetic gaps g2 and g3 of the twin straight gap magnetic circuit 40 attached inside the frame 34. In this connection, in the slim-type speaker unit 21 in FIG. 7, the description of the baffle panel 36 of the speaker unit 21 (FIG. 4) is omitted for simplification of explanation.

In this speaker unit 21 (FIG. 7), it is attached in the state where the top end of the flat voice coil drive 49 and the almost center part of the diaphragm 31 are abutted, and the flat voice coil drive 49 is attached to a roll-form damper 35 in the state where the bottom part of the flat voice coil drive 49 is passed through the center part of the roll-form damper 35 attached to the bottom part of the frame 34. Thereby, it can move in the forward and backward direction shown by an arrow between the magnetic gaps g2 and g3.

Figure 8A:
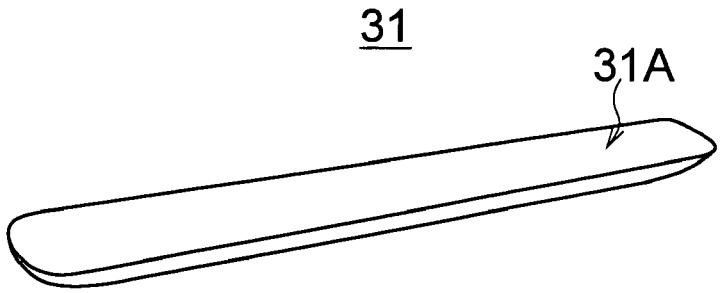
FIGS. 8A to 8C are schematic diagrams showing the configuration of a diaphragm.
Figure 8B:
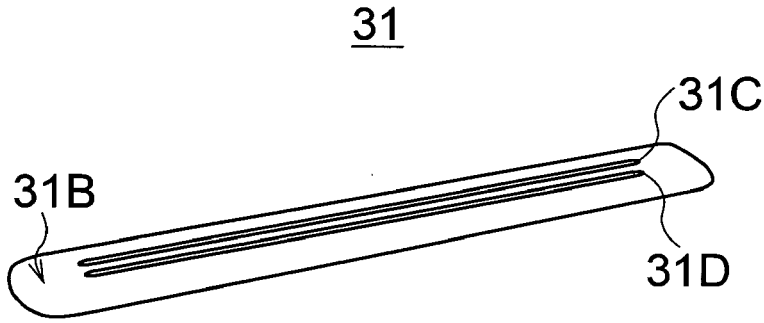
Figure 8C:
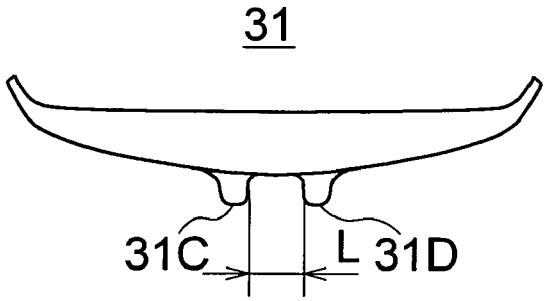

As shown in FIG. 8A, the diaphragm 31 is made of for example expanded mica material in a long and narrow boat in that its front side 31A is slightly concave. As shown in FIGS. 8B and 8C, the diaphragm 31 has a configuration that projections 31C and 31D in the form of two rails are provided at the center of its back side 31B.

In this diaphragm 31, a distance L between the projections 31C and 31D is almost the same as the thickness D of the flat voice coil drive 49 (FIG. 7). The projections 31C and 31D are used in positioning when the top end of the flat voice coil drive 49 and the center part of the diaphragm 31 are attached, and in the state where it is forcedly fixed, the top end of the flat voice coil drive 49 is inserted in between the projections 31C and 31D.

Note that, the diaphragm 31 is attached to the frame 34 via edges 41A and 41B. However, the back side 31B and the edges 41A and 41B are attached, more particularly, in the state where the front side 31A of the diaphragm 31 faces outward. Therefore, a larger area can be taken for the diaphragm 31 comparing to the case of being attached in the state where the edges 41A and 41B are exposed to the outside. Thus, bass characteristic can be improved.

Figure 9:
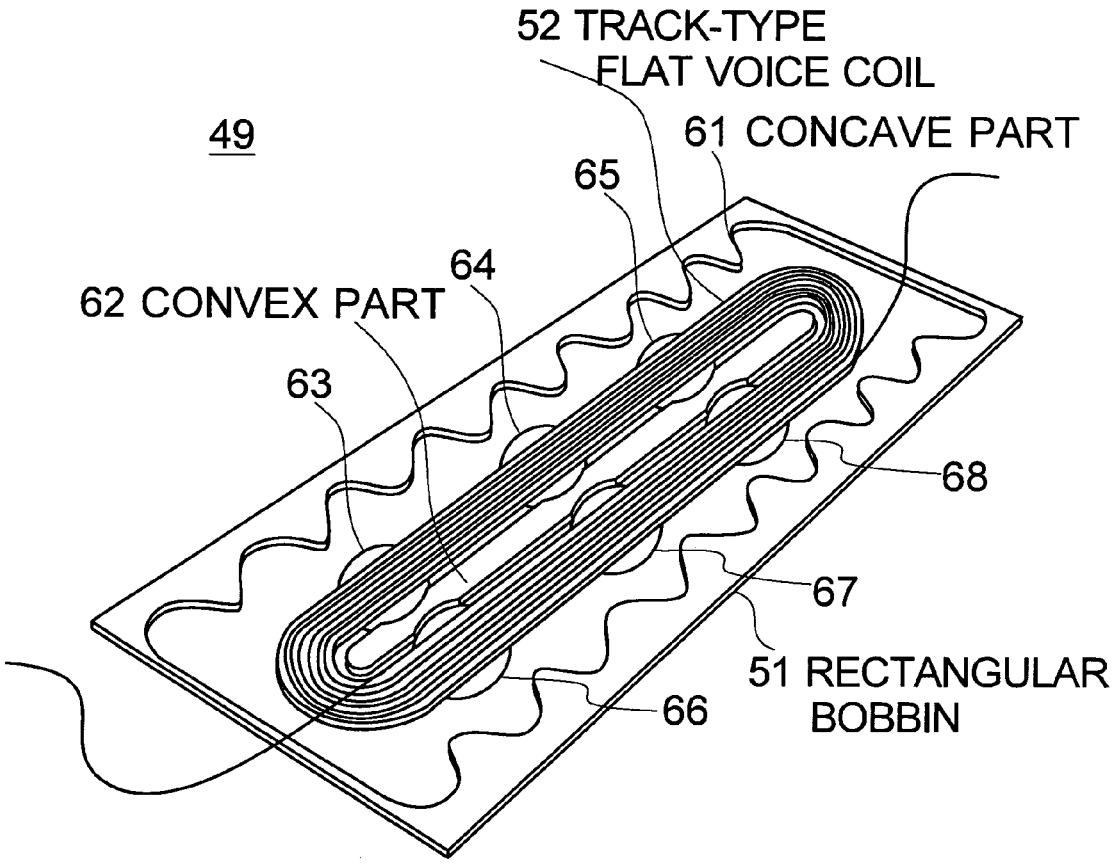
FIG. 9 is a schematic perspective view showing the overall configuration of a flat voice coil drive.

As shown in FIG. 9, the flat voice coil drive 49 has a configuration that a track-type flat voice coil 52 is adhered to the almost center of a rectangular bobbin 51 in the form of a thin plate and made of for example polyimide film. Note that, as a material of the rectangular bobbin 51, polyimide film, polyamide nonwoven, a glass polyimide impregnated sheet, aluminum, brass, heat resistant kraft, a mica sheet, or the like will be used.

Figure 10:
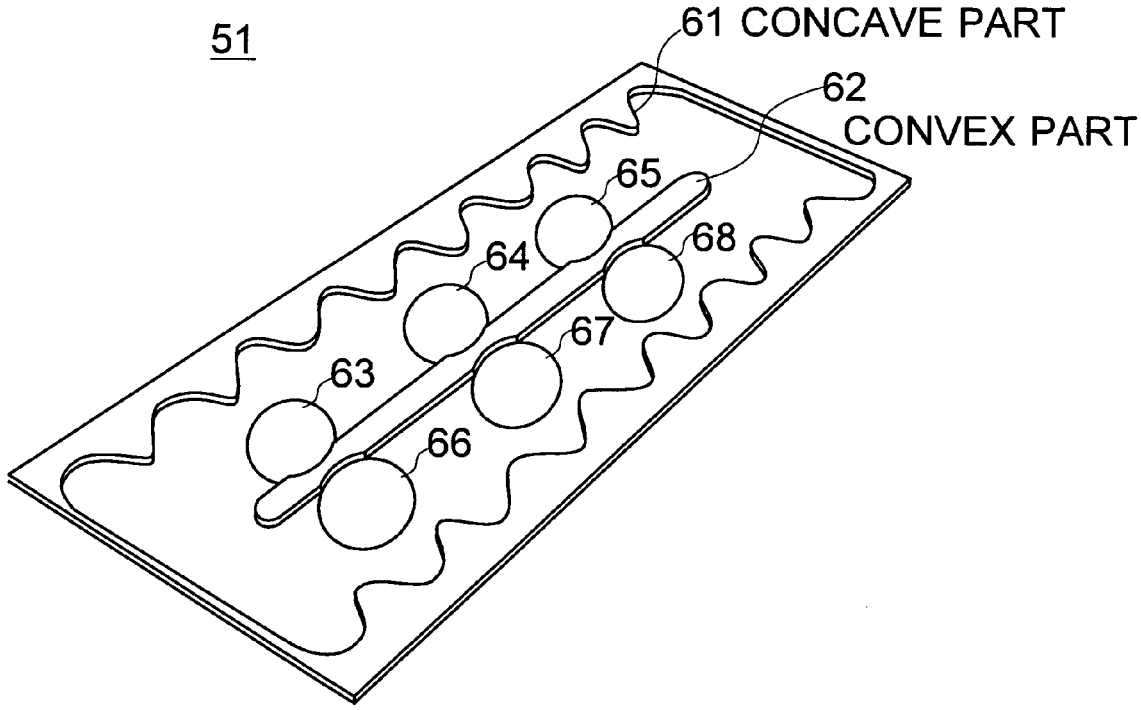
FIG. 10 is a schematic perspective view showing the configuration of a rectangular bobbin.

As shown in FIG. 10, in the rectangular bobbin 51, a concave part 61 being a minute difference in level that have a boundary in wave form along two sides in the longitudinal direction and in linear form along two sides in the lateral direction is formed, and a long and narrow convex part 62 that is slightly smaller than the inside area of the track-type flat voice coil 52 and has the same difference in level as the concave part 61 is formed at the almost center of the rectangular bobbin 51.

Here, since the rectangular bobbin 51 (FIG. 10) is formed in a thin plate shape, it has a defect that strength in the backward and forward direction of the diaphragm 31 shown by the arrow (FIG. 7) is not strong, comparing to a cylindrical voice coil bobbin used in common speaker units. However, it is considered that the strength in the backward and forward direction that the diaphragm 31 vibrates is sufficiently reinforced with the concave part 61 provided at a position separated from the track-type flat voice coil 52 of the rectangular bobbin 51 and the convex part 62 provided for the positioning of the track-type flat voice coil 52.

Further, in the rectangular bobbin 51 (FIG. 10), six through holes 63-68 are formed so as to overlap with a part that the track-type flat voice coil 52 is adhered around the convex part 62. Thereby, when the track-type flat voice coil 52 is positioned and adhered via the convex part 62, the linear part of the track-type flat voice coil 52 faces to the through holes 63-68.

Figure 11:
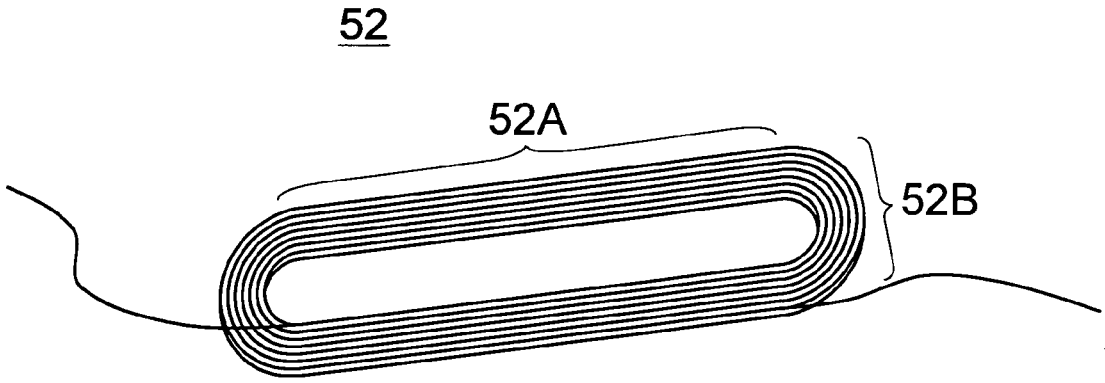
FIG. 11 is a schematic diagram showing the configuration of a track-type flat voice coil.

As shown in FIG. 11, the track-type flat voice coil 52 is a track type coiled in a single layer, and has a shape coiled in the form of a flat to be adhered to the rectangular bobbin 51. As the track form of the track-type flat voice coil 52, in order to generate drive force in the arrow direction in the magnetic gaps g2 and g3 shown in FIG. 7, it is desirable that a linear part 52A along the two sides in the longitudinal direction is long and a curve part 52B is short, as matching to the rectangular bobbin 51.

Figure 12:
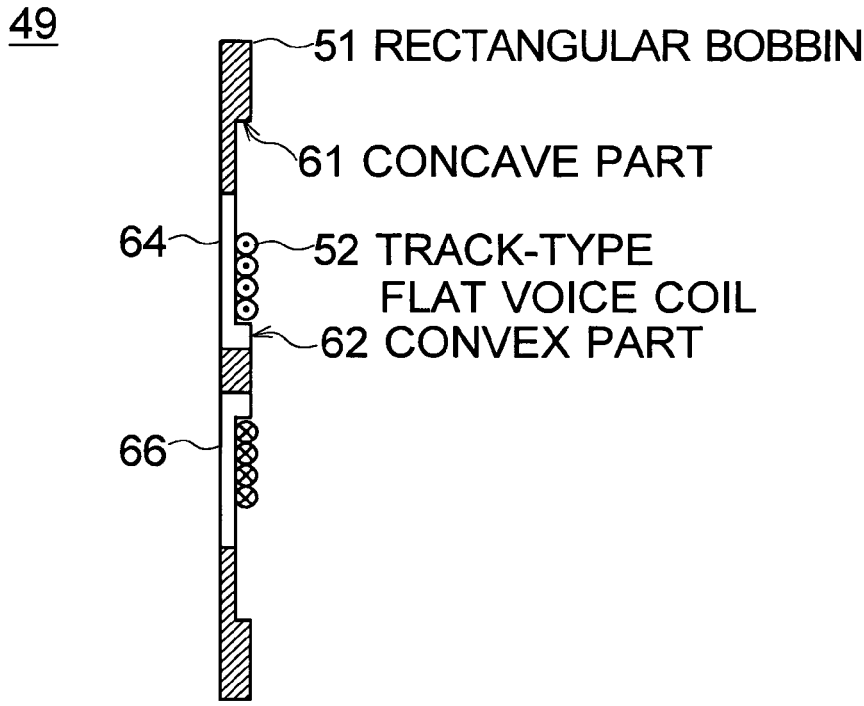
FIG. 12 is a schematic sectional view showing the sectional configuration of the flat voice coil drive.

As shown in FIG. 12, the flat voice coil drive 49 is formed by that the track-type flat voice coil 52 is adhered to the rectangular bobbin 51. However, at this time, the differences in level of the concave part 61 and the convex part 62 are set smaller than the wire diameter of the track-type flat voice coil 52. Therefore, the track-type flat voice coil 52 is adhered as slightly more projecting than the surface of the rectangular bobbin 51.

Figure 13A:
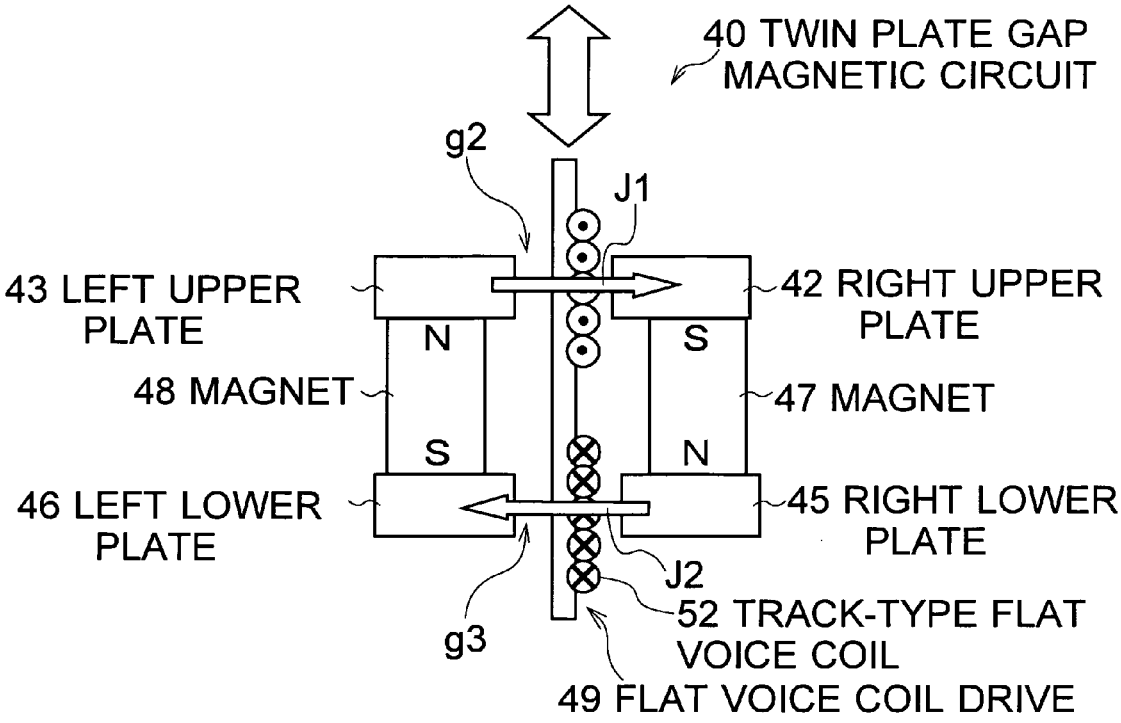
FIGS. 13A and 13B are schematic diagrams for explaining drive force by the twin straight gap magnetic circuit.
Figure 13B:
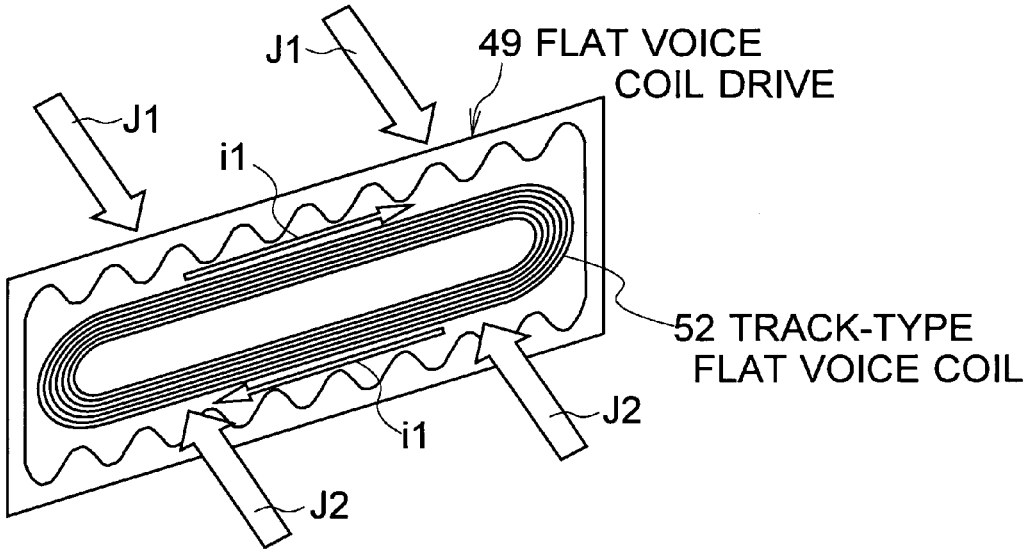

Thereby, as shown in FIGS. 13A and 13B, when the flat voice coil drive 49 is disposed between the magnetic gaps g2 and g3 of the twin straight gap magnetic circuit 40, it is apt to receive magnetic flux J1 in the above magnetic gap g2 and magnetic flux J2 in the magnetic gap g3. Thus, when a current i1 was flown to the track-type flat voice coil 52, drive force for moving the flat voice coil drive 49 back and forth in the backward and forward direction that the diaphragm 31 (not shown) shown by thick arrows vibrates can be generated in the magnetic gaps g2 and g3, according to the Fleming's left hand rule.

Figure 14:
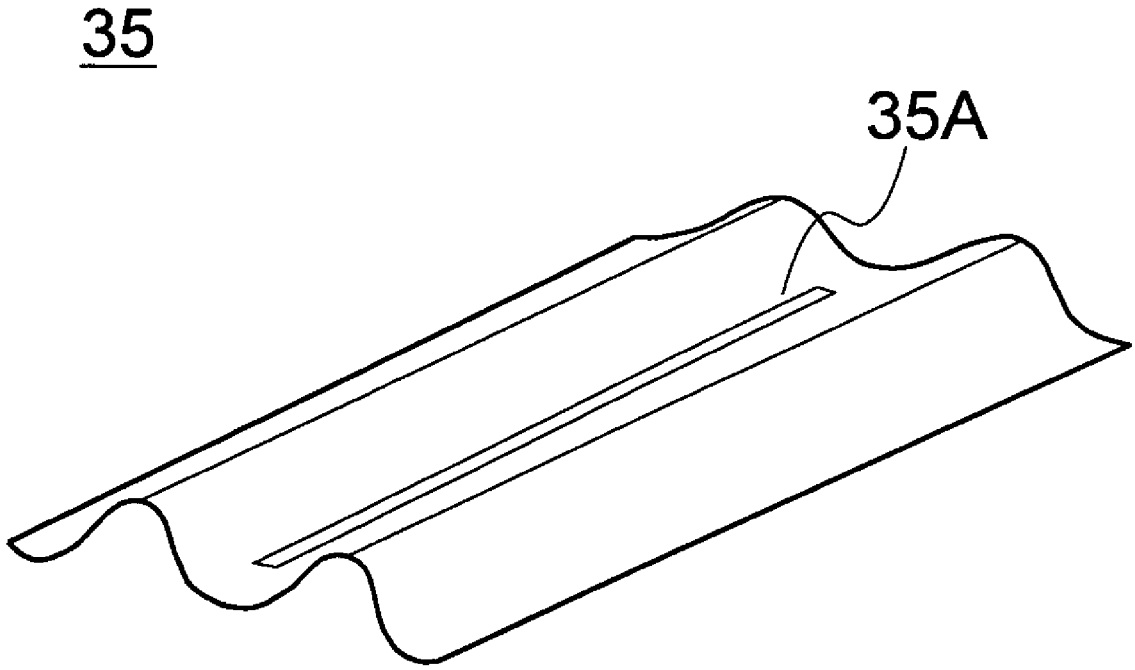
FIG. 14 is a schematic perspective view showing the configuration of a roll-form damper.

Finally, as shown in FIG. 14, the roll-form damper 35 is that stably supports the flat voice coil drive 49 in the magnetic gaps g2 and g3 of the twin straight gap magnetic circuit 40. As its material, that heat molding is performed on an weave in that thermoset such as phenolic resin is impregnated, a butter fly damper by that a Bakelite panel was punched, a butter fly damper made of injection molding resin or the like will be used. AS the shape of a damper, in order to make it follow back and force movement in the vibrating direction, a corrugation shape formed by a plurality of waves, a roll shape or the like is desirable.

The section of this roll-form damper 35 has an almost M-shape. A long and narrow through hole 35A to make pass through the bottom part of the rectangular bobbin 51 of the flat voice coil drive 49 is provided at its almost center part, and it is attached in the state where the bottom part of the rectangular bobbin 51 slightly projects from the through hole 35A.

By the way, in the speaker unit 21 (FIG. 7), so-called magnetic fluid R1 is enclosed in the magnetic gap g2 between the right upper plate 42 and the left upper plate 43, and a magnetic gap g3 between the right lower plate 45 and the left lower plate 46. Thereby, improvement in stability of the vibration of the flat voice coil drive 49, improvement in the density of the magnetic fluxes J1 and J2, and improvement in heat radiation in the track-type flat voice coil 52 can be contrived.

Here, the magnetic fluid R1 means a liquid that consists of magnetic atoms of which the particle diameter is 10.0 nm (100 Å) degree (for example, iron oxide), a surface-active agent and base liquid, and reacts to a magnet including a substance high in magnetic permeability, and is stable colloid solution in that magnetic atoms in the base liquid do not cohere (flocculate) by absorbing the surface-active agent on the surface of the magnetic atoms. Note that, as a base liquid, water, hydrocarbon oil, ester oil, fluorine oil or the like will be used by considering a use and using environment.

This magnetic fluid R1 has a characteristic that although it is nonmagnetic liquid when the magnetic field is zero, it is magnetized by making the magnetic field react from the outside, and if the magnetic field from the outside is removed, the magnetization disappears. By using this, the flat voice coil drive 49 can be held at the center of the magnetic gaps g2 and g3.

Figure 15A:
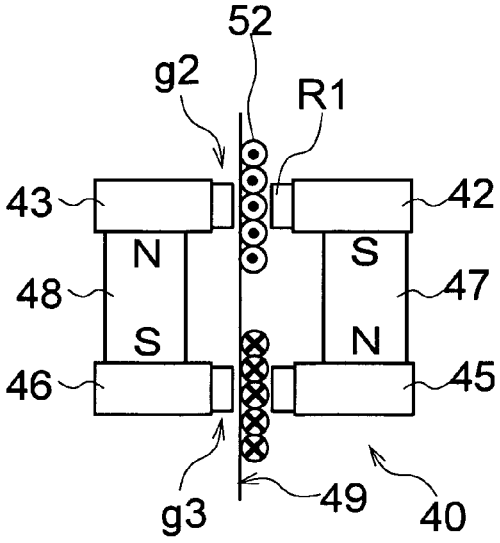
FIGS. 15A to 15D are schematic diagrams for explaining a centering function by magnetic fluid.
Figure 15B:
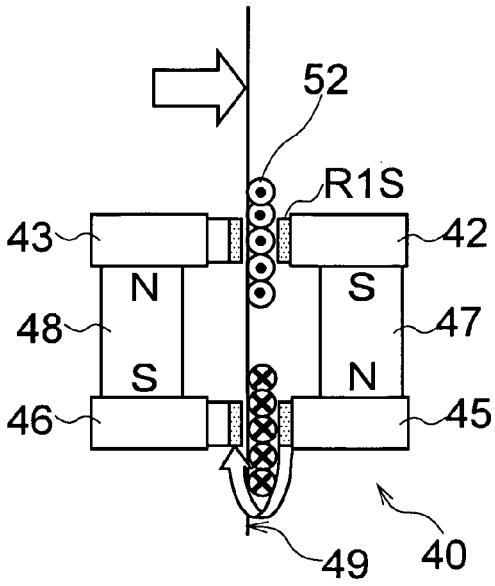

Practically, in the speaker unit 21, from the state where as shown in FIG. 15A, the flat voice coil drive 49 is disposed in the magnetic fluid R1 in the magnetic gaps g2 and g3 of the twin straight gap magnetic circuit 40, if receiving external force such that the flat voice coil drive 49 shifts from the center of the magnetic gaps g2 and g3, as shown in FIG. 15B, magnetic fluid R1S for an amount corresponding to the force is pushed out and moves into an arrow direction.

Figure 15C:
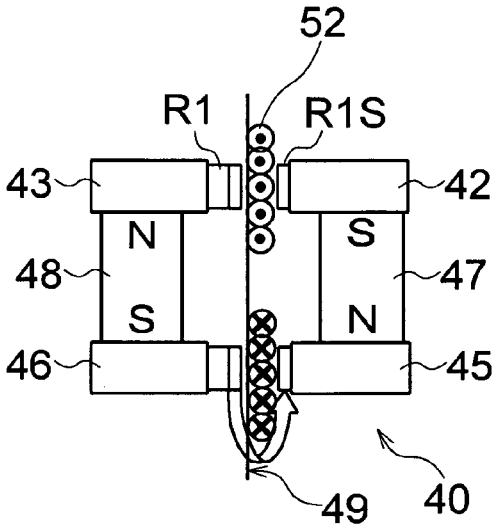
Figure 15D:
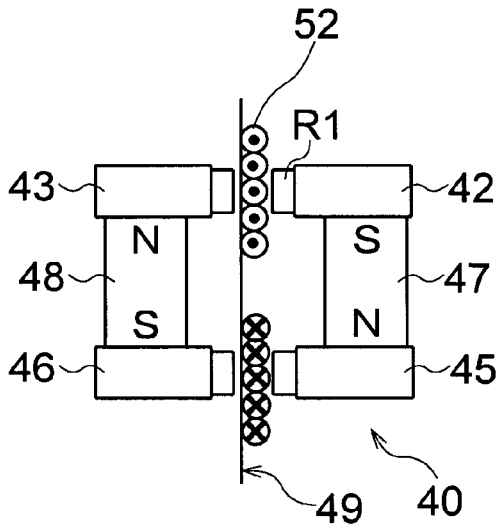

However, as shown in FIG. 15C, the speaker unit 21 has a characteristic that the magnetic fluid R1S for the moving amount tries to approach to a stronger magnetic field on the right lower plate 45 side. Therefore, the magnetic fluid R1S for the moving amount returns to an arrow direction. As a result, the flat voice coil drive 49 can be held again at the center of the magnetic gaps g2 and g3.

Accordingly, in the speaker unit 21, the flat voice coil drive 49 can be always held at the center of the magnetic gaps g2 and g3, by not only the roll-form damper 35 but also the centering function of the magnetic fluid R1. Thus, that the above flat voice coil drive 49 shifts to either left or right from the center of the magnetic gaps g2 and g3, and is touched to the right upper plate 42, the left upper plate 43, the right lower plate 45 and the left lower plate 46 can be prevented double.

(3) Characteristics of Speaker Unit

Figure 16:
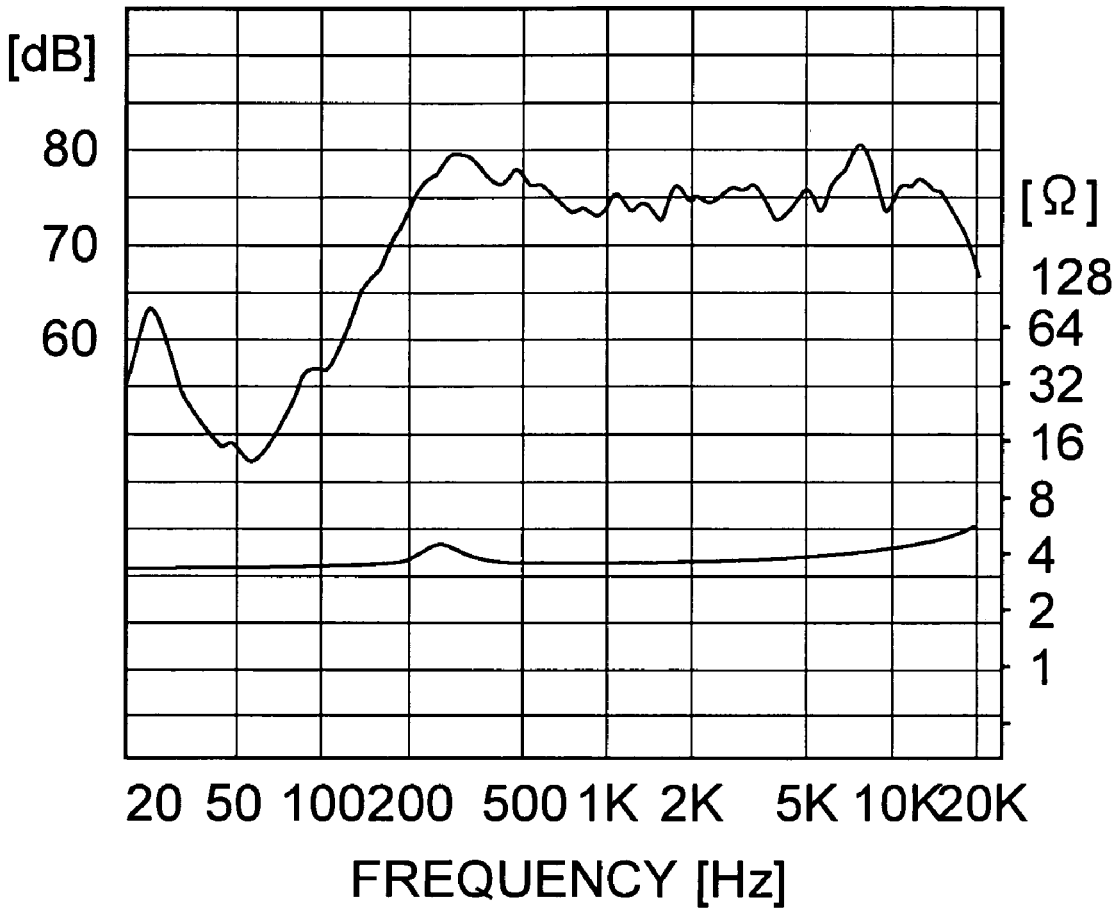
FIG. 16 is a characteristic curvilinear diagram for explaining the sound pressure frequency characteristic of a speaker unit.

FIG. 16 shows the inspection result for the sound pressure frequency characteristics of the speaker unit 21 having the above configuration. It is found that in this speaker unit 21, a sound pressure level is comparatively high from the midrange and treble to the bass of approximately 200 Hz. Therefore, it can be said that if making a sub-woofer cover the bass below 200 Hz, a full range can be covered by the sub-woofer and the speaker unit 21.

FIG. 17A shows directional characteristics in a conventional speaker unit 1, and FIG. 17B shows directional characteristics in the slim-type speaker unit 21 in an embodiment of the present application.

In the conventional speaker unit 1 (FIG. 17A), it is in the state where although the directional characteristic is generally superior at a frequency band below 1000 Hz, at a frequency band over 2000 Hz, it cannot be said that the directional characteristic to the right and left direction and the back direction of the speaker unit 1 shown by a thick arrow is superior.

On the other hand, in the slim-type speaker unit 21 of an embodiment of the present application (FIG. 17B), it is found that even if it is at any frequency band of 600 Hz, 1000 Hz, 2000 Hz, 4000 Hz and 8000 Hz, it has superior directional characteristic over all directions, not only the front direction of the speaker unit 21 shown by a thick arrow but also including the left and right direction and the back direction. This is considered because in the slim-type speaker unit 21, the width is very narrow comparing to the conventional speaker unit 1, and it becomes close to a line sound source.

(4) Operation and Effect

According to the above configuration, in the slim-type speaker unit 21 in an embodiment of the present application, the flat voice coil drive 49 is disposed at the almost center of the magnetic gaps g2 and g3 of the twin straight gap magnetic circuit 40. If current i1 is flown to the track-type flat voice coil 52, drive force to move the flat voice coil drive 49 back and forth in the backward and forward direction that the diaphragm 31 vibrates is generated, according to the Fleming's left hand rule.

At this time, in the flat voice coil drive 49, the rectangular bobbin 51 is formed by a thin plate material being a film or a sheet. Therefore, in a part that the strength of the diaphragm 31 in the vibrating direction is not strong, the concave part 61 having a slight difference in level that has a boundary in wave form along the two sides in the longitudinal direction in the rectangular bobbin 51, and a boundary in linear form along the two sides in the lateral direction is formed, and the long and narrow convex part 62 in a slightly smaller size than the inside area of the track-type flat voice coil 52 having the same difference in level as the concave part 61 is formed at the almost center of the rectangular bobbin 51. Thereby, the strength of the diaphragm 31 in the vibrating direction is vastly improved by the rib structure of the concave part 61 and the convex part 62.

Accordingly, in the speaker unit 21, the strength of the rectangular bobbin 51 itself in the driving direction of the flat voice coil drive 49 is improved. Thus, deterioration in sound quality caused by lack of the strength of the rectangular bobbin 51 can be prevented.

Further, in the speaker unit 21 (FIG. 7), magnetic fluid R1 having a characteristic that tries to get close to a stronger magnetic field is enclosed in the magnetic gaps g2 and g3 of the twin straight gap magnetic circuit 40. Thereby, even if it receives external force such that the flat voice coil drive 49 shifts to either side from the state of being disposed at the almost center of the magnetic gaps g2 and g3, the flat voice coil drive 49 can be centered to the almost center of the magnetic gaps g2 and g3, by movement that magnetic fluid R1S which was temporarily moved by the force tries to get close to a stronger magnetic field.

Accordingly, in the speaker unit 21, the flat voice coil drive 49 can be held at the almost center of the magnetic gaps g2 and g3 by the centering function of the magnetic fluid R1, together with the roll-form damper 35. Thus, it can be avoided that the above flat voice coil drive 49 touches to the right upper plate 42, the left upper plate 43, the right lower plate 45 and the left lower plate 46, and deterioration in sound quality can be prevented.

Further, in the speaker unit 21 (FIG. 7), the back side 31B of the diaphragm 31 is attached to the edges 41A and 41B in the state where the front side 31A of the diaphragm 31 is faced to the outside. Therefore, a larger area can be taken for the diaphragm 31, comparing to the case of being attached in the state where the edges 41A and 41B are exposed to the outside. Thus, lack of bass characteristic can be prevented while the width of the frame 34 is formed narrow as well as possible, and high quality sounds can be outputted.

According to the above configuration, in the speaker unit 21, since the strength of the rectangular bobbin 51 itself in the driving direction of the flat voice coil drive 49 is improved by rib structure, deterioration in sound quality caused by lack of the strength of the rectangular bobbin 51 can be prevented, and high quality sound can be outputted.

(5) Other Embodiments

Figure 18:
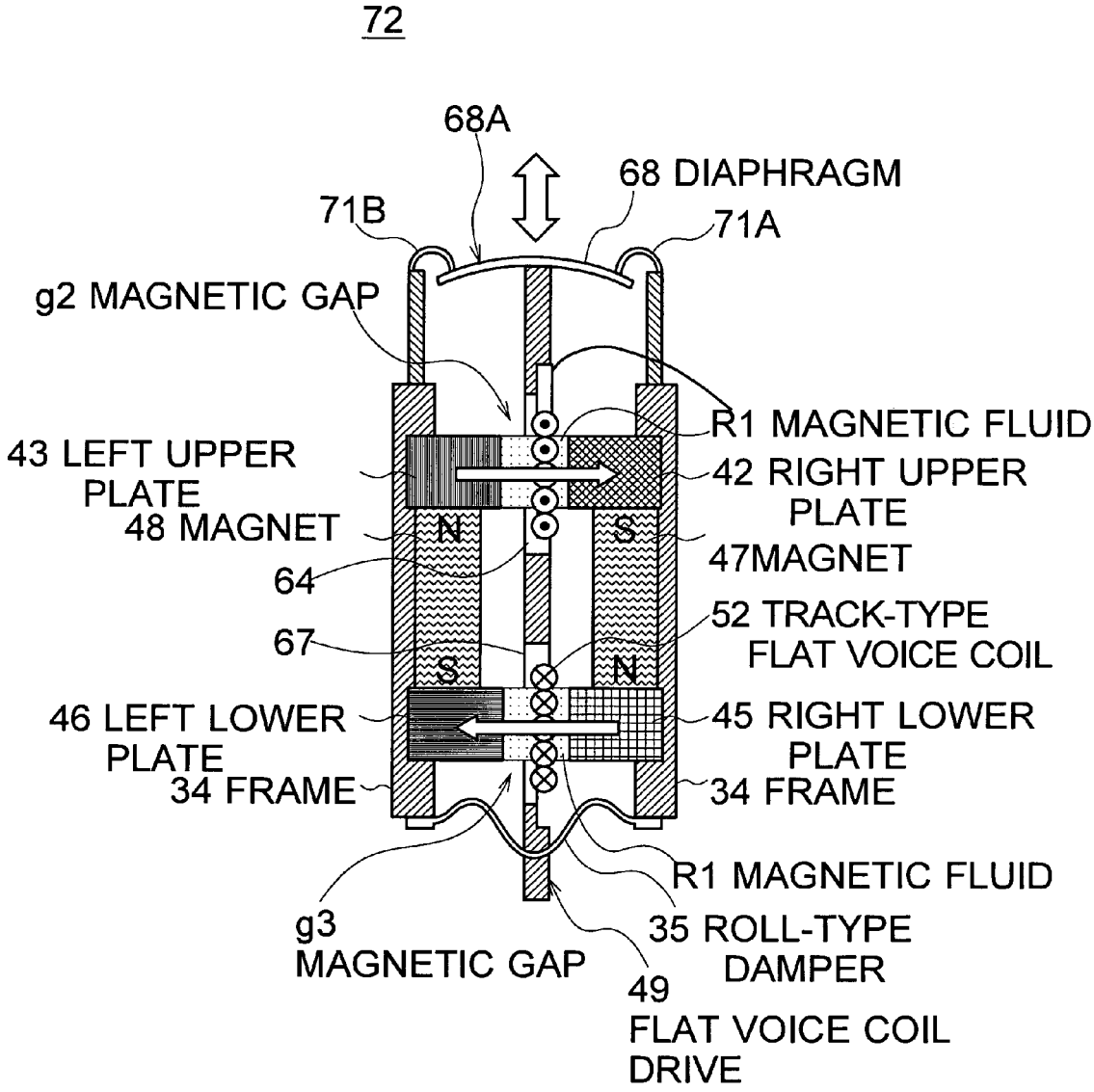
FIG. 18 is a schematic sectional view showing the sectional configuration of a slim-type speaker unit in other embodiment (1)

In the aforementioned embodiment, as shown in FIG. 7, it has dealt with the case of using the speaker unit 21 in that the back side 31B of the diaphragm 31 is attached to the edges 41A and 41B in the state where the front side 31A of the diaphragm 31 is faced to the outside without that the edges 41A and 41B are exposed to the outside. However, the present invention is not only limited to this but also as shown in FIG. 18 in that the same reference numerals are added to the corresponding parts to FIG. 7, a speaker unit 72 which uses a diaphragm 61 of which the facing direction is opposite to the diaphragm 31, and in that edges 71A and 71B are exposed to the outside in the state where the front side 61A of the diaphragm 61 is faced to the outside, and the edges 71A and 71B are attached to the front side 61A of the diaphragm 61 may be used.

Figure 19:
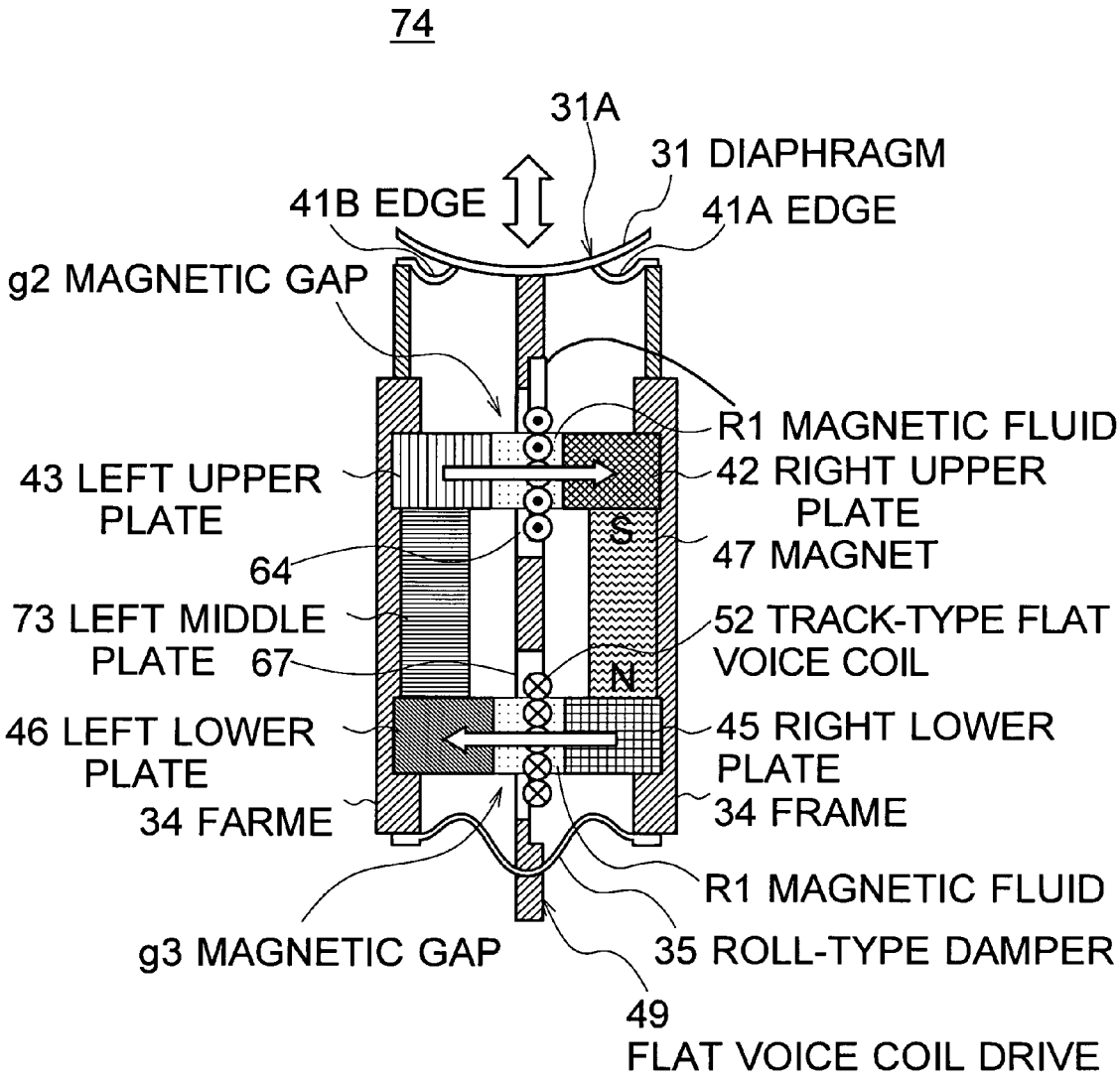
FIG. 19 is a schematic sectional view showing the sectional configuration of a slim-type speaker unit in other embodiment (2)

Further, in the aforementioned embodiment, it has dealt with the case of using the speaker unit 21 in that the two magnets 47 and 48 are disposed in the twin straight gap magnetic circuit 40. However, the present invention is not only limited to this but also as shown in FIG. 19, a speaker unit 74 which uses for example only one magnet 47, and in that a left middle plate 73 is disposed in place of the magnet 48, and magnetic fluxes J1, J2 are generated only by the magnet 47 may be used.

Figure 20:
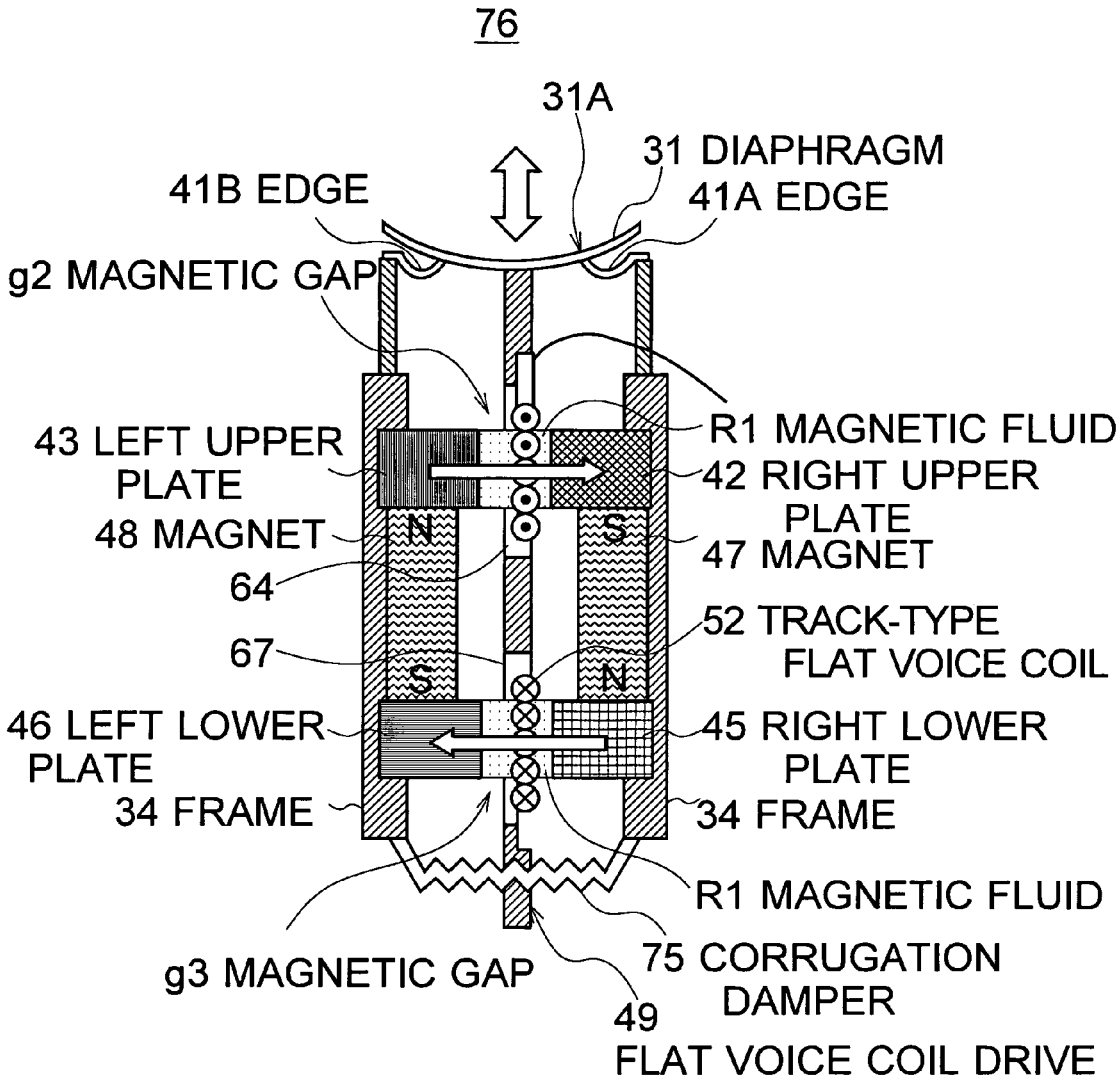
FIG. 20 is a schematic sectional view showing the sectional configuration of a slim-type speaker unit in other embodiment (3)

Further, in the aforementioned embodiment, it has dealt with the case of using the speaker unit 21 in that the roll-form damper 35 (FIG. 7) for supporting the bottom part of the rectangular bobbin 51 of the flat voice coil drive 49 is adopted. However, the present invention is not only limited to this but also as shown in FIG. 20, a speaker unit 76 in which a corrugation damper 75 in plural waves form is adopted in place of the roll-form damper 35 may be used.

Figure 21:
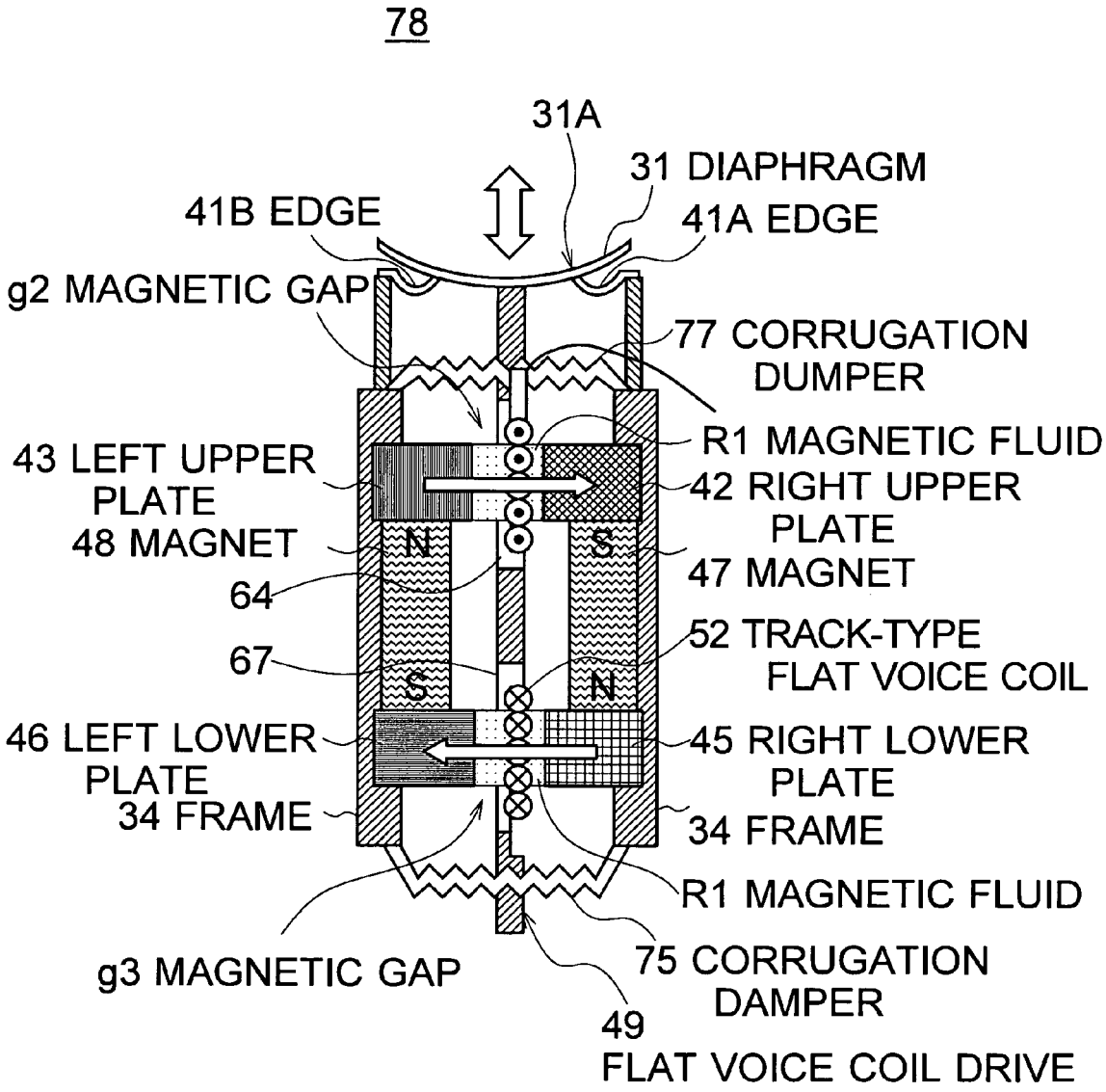
FIG. 21 is a schematic sectional view showing the sectional configuration of a slim-type speaker unit in other embodiment (4)

Further, in the aforementioned embodiment, it has dealt with the case of using the speaker unit 21 in that the roll-form damper 35 (FIG. 7) for supporting the bottom part of the rectangular bobbin 51 of the flat voice coil drive 49 is adopted. However, the present invention is not only limited to this but also as shown in FIG. 21 in that the same reference numerals are added to the corresponding parts to FIG. 20, a speaker unit 78 in which a corrugation damper 75 in plural waves form is adopted in place of the roll-form damper 35, and a corrugation damper 77 in plural waves form for supporting the top part of the rectangular bobbin 51 of the flat voice coil drive 49 is adopted may be used.

Figure 22:
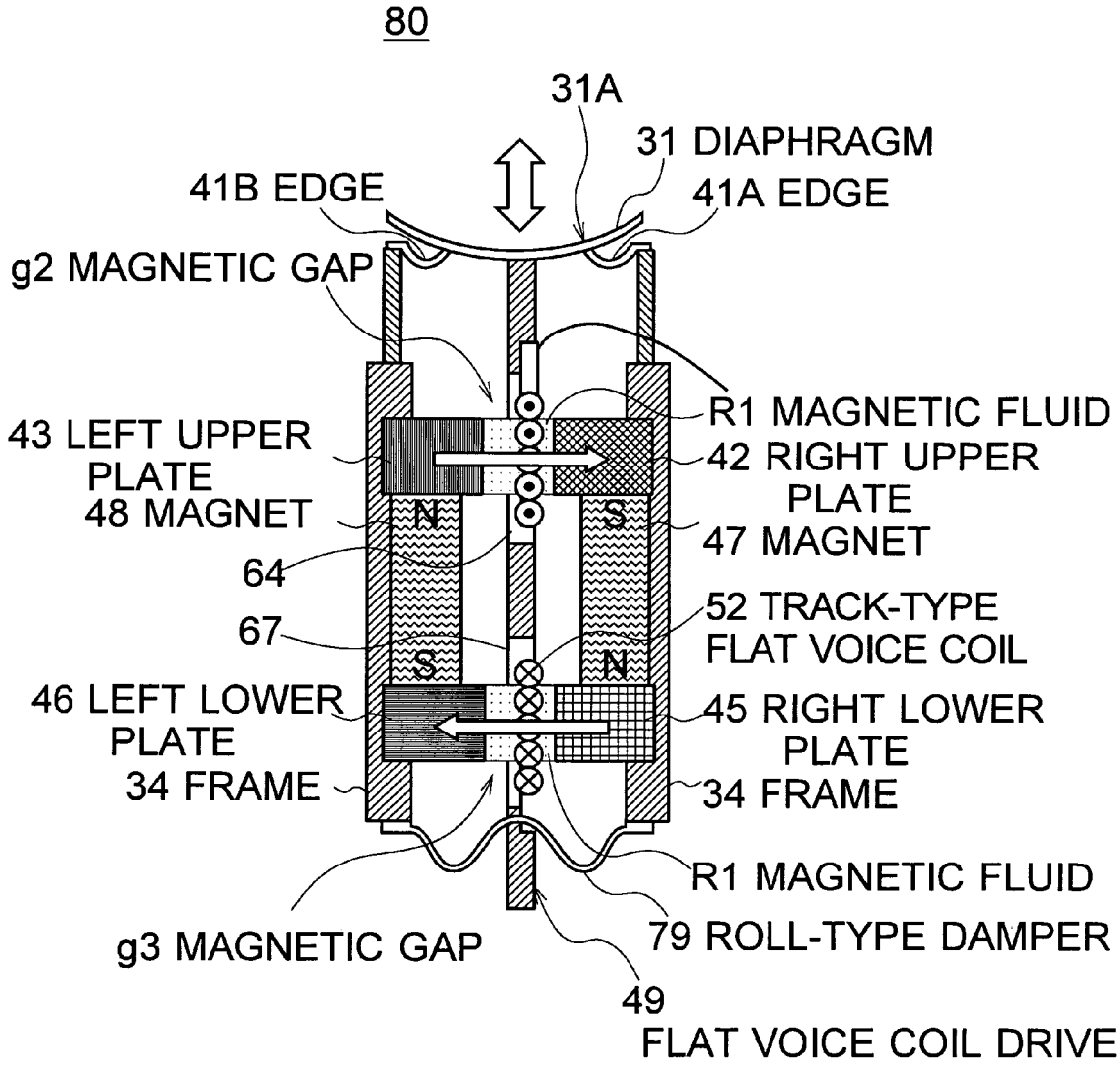
FIG. 22 is a schematic sectional view showing the sectional configuration of a slim-type speaker unit in other embodiment (5)

Further, in the aforementioned embodiment, it has dealt with the case of using the speaker unit 21 in that the roll-form damper 35 (FIG. 7) having a section in an almost M-shape is adopted. However, the present invention is not only limited to this but also as shown in FIG. 22, a speaker unit 80 in which a roll-form damper 79 having a section in an almost W-shape is adopted may be used.

Figure 23:
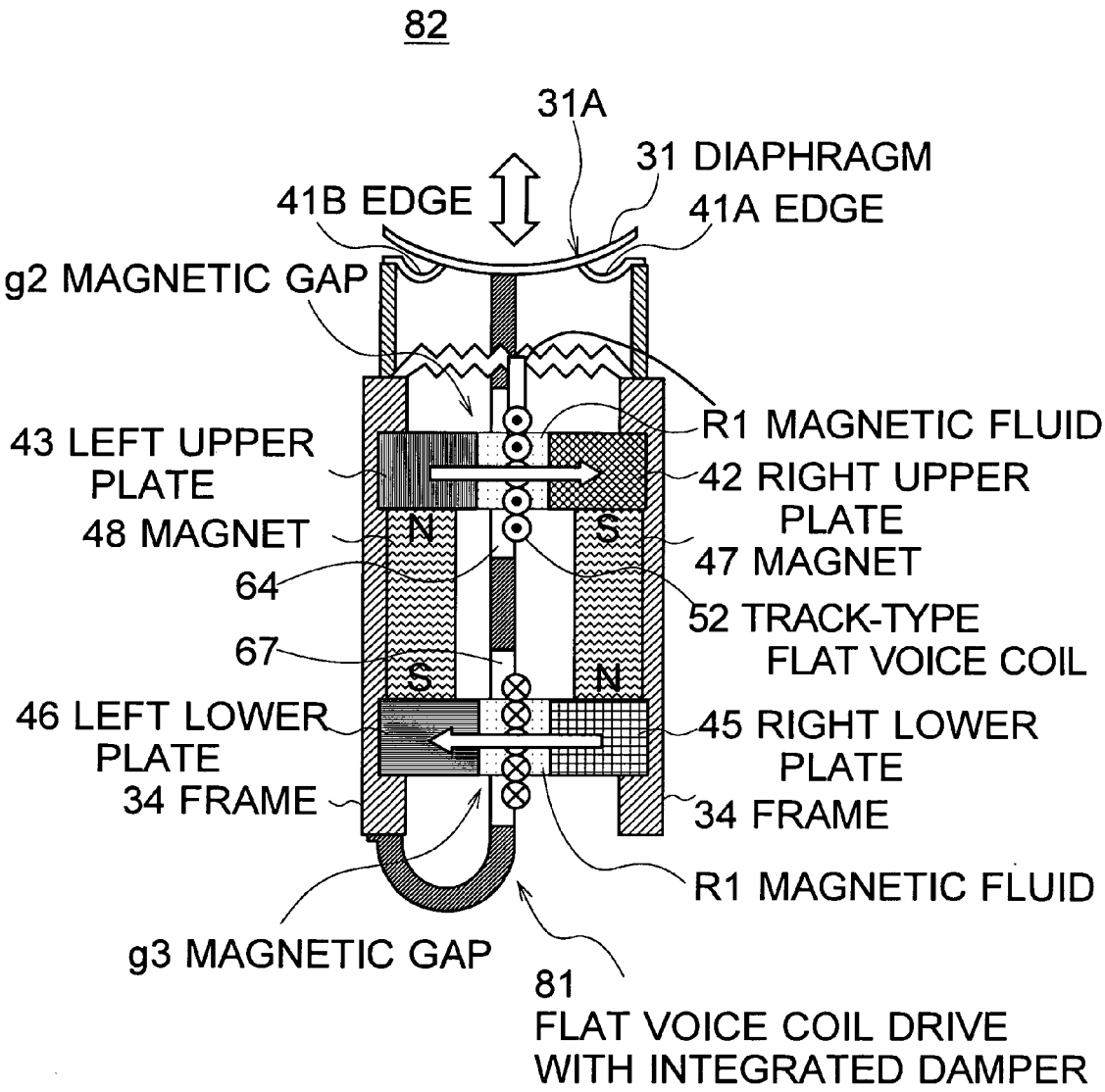
FIG. 23 is a schematic sectional view showing the sectional configuration of a slim-type speaker unit in other embodiment (6)

Further, in the aforementioned embodiment, it has dealt with the case of using the speaker unit 21 in that the roll-form damper 35 (FIG. 7) is adopted. However, the present invention is not only limited to this but also as shown in FIG. 23 in that the same reference numerals are added to the corresponding parts to FIG. 7, a speaker unit 82 using a flat voice coil drive with integrated damper 81 in that the bottom part of the rectangular bobbin 51 is extended and formed in roll form, and is connected to the bottom part of the frame 34 may be used.

In this case, in the speaker unit 82 (FIG. 23), connecting the flat voice coil drive 49 to the roll-form damper 35 is unnecessary as the speaker unit 21 (FIG. 7). Thus, the configuration can be further simplified.

Figure 24:
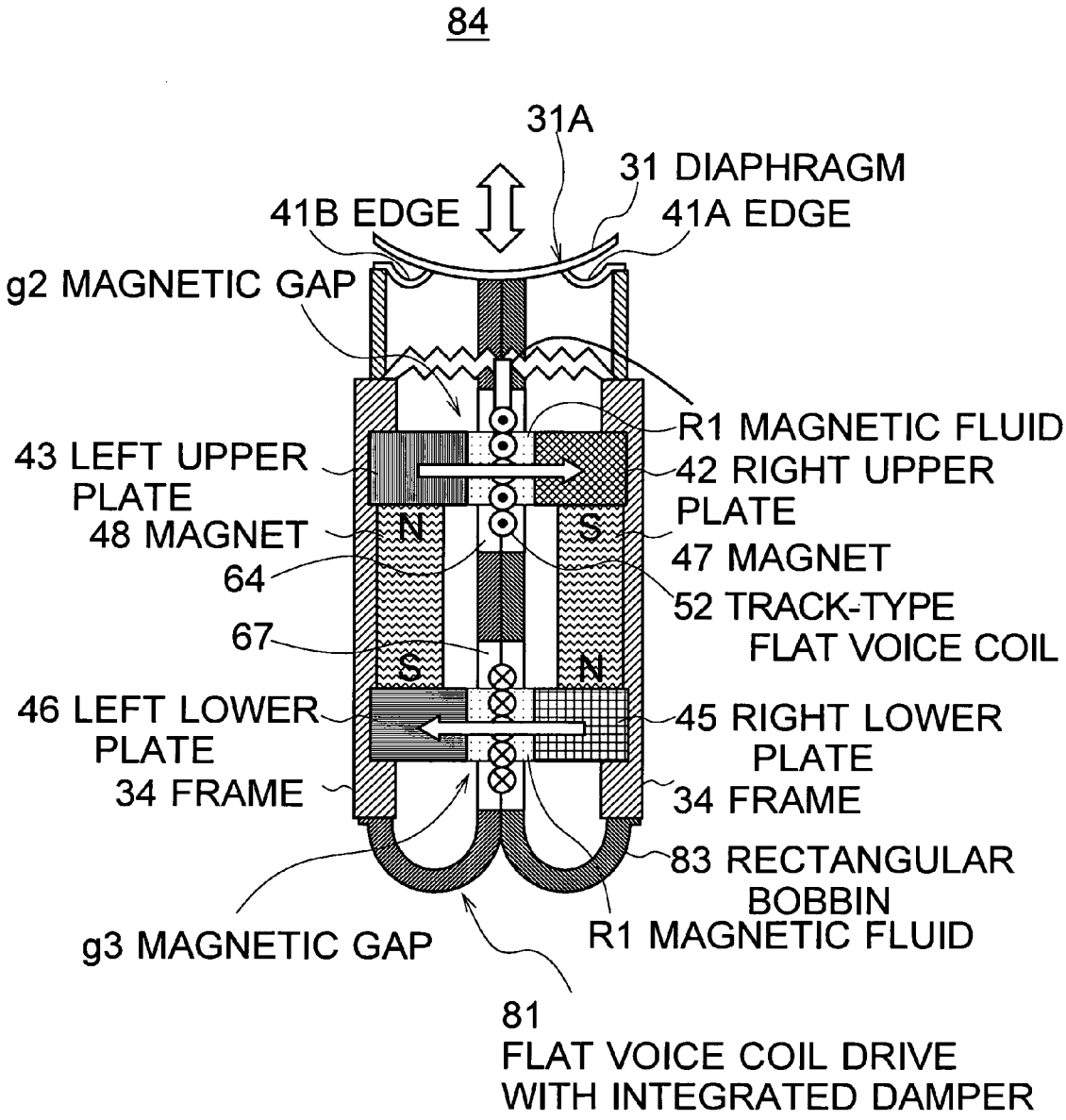
FIG. 24 is a schematic sectional view showing the sectional configuration of a slim-type speaker unit in other embodiment (7)

Further, in the aforementioned embodiment, it has dealt with the case of using the speaker unit 21 in that the roll-form damper 35 (FIG. 7) is adopted. However, the present invention is not only limited to this but also as shown in FIG. 24 in that the same reference numerals are added to the corresponding parts to FIG. 23, a speaker unit 84 in which a damper having a section in almost W-shape resultant from that from on the track-type flat voice coil 52 in the flat voice coil drive with integrated damper 81, the bottom part is extended and is adhered to a rectangular bobbin 83 in roll form, and the top of the flat voice coil drive with integrated damper 81 and the top of the roll form of the rectangular bobbin 83 are connected to the bottom part of the frame 34 respectively is adopted may be used.

In this case, in the speaker unit 84, the structure can be simplified comparing to the case of connecting the flat voice coil drive 49 to the roll-form damper 35 as the speaker unit 21 (FIG. 7). At the same time, the damper function of the flat voice coil drive with integrated damper 81 and strength in the vibrating direction can be vastly improved comparing to the speaker unit 82 (FIG. 23).

Figure 25:
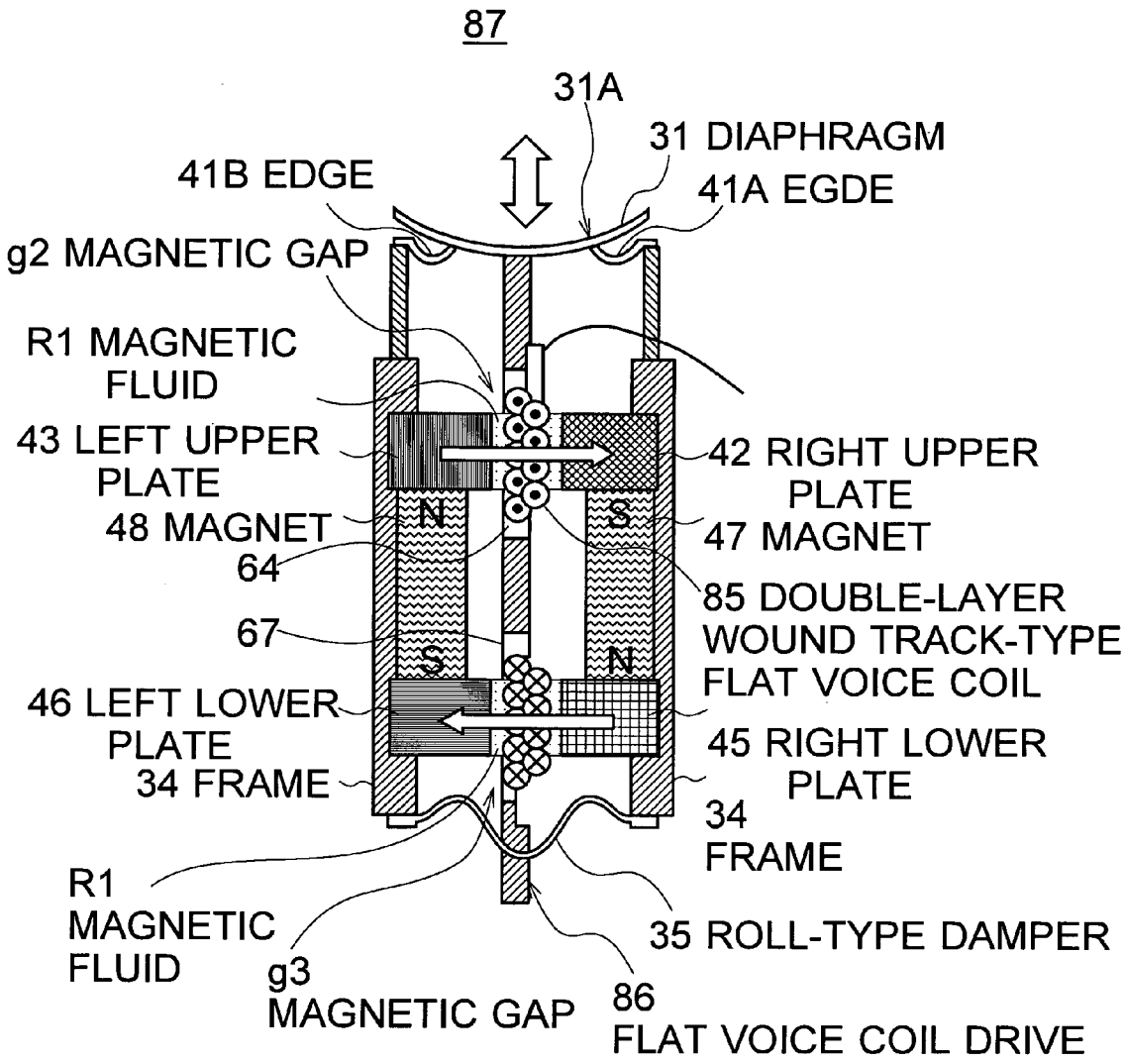
FIG. 25 is a schematic sectional view showing the sectional configuration of a slim-type speaker unit in other embodiment (8)

Further, in the aforementioned embodiment, it has dealt with the case of using the speaker unit 21 in that the flat voice coil drive 49 in that the track-type flat voice coil 52 being a single layer wound track type is adhered to the rectangular bobbin 51 is adopted. However, the present invention is not only limited to this but also as shown in FIG. 25 in that the same reference numerals are added to the corresponding parts to FIG. 7, a speaker unit 87 having a flat voice coil drive 86 in that a double-layer wound track flat voice coil 85 is adhered may be used. Furthermore, speaker units having a flat voice coil drive in that multi-layer wound track-type flat voice coil more than that, such as triple-layer wound and quadruple-layer wound may be used.

Figure 26:
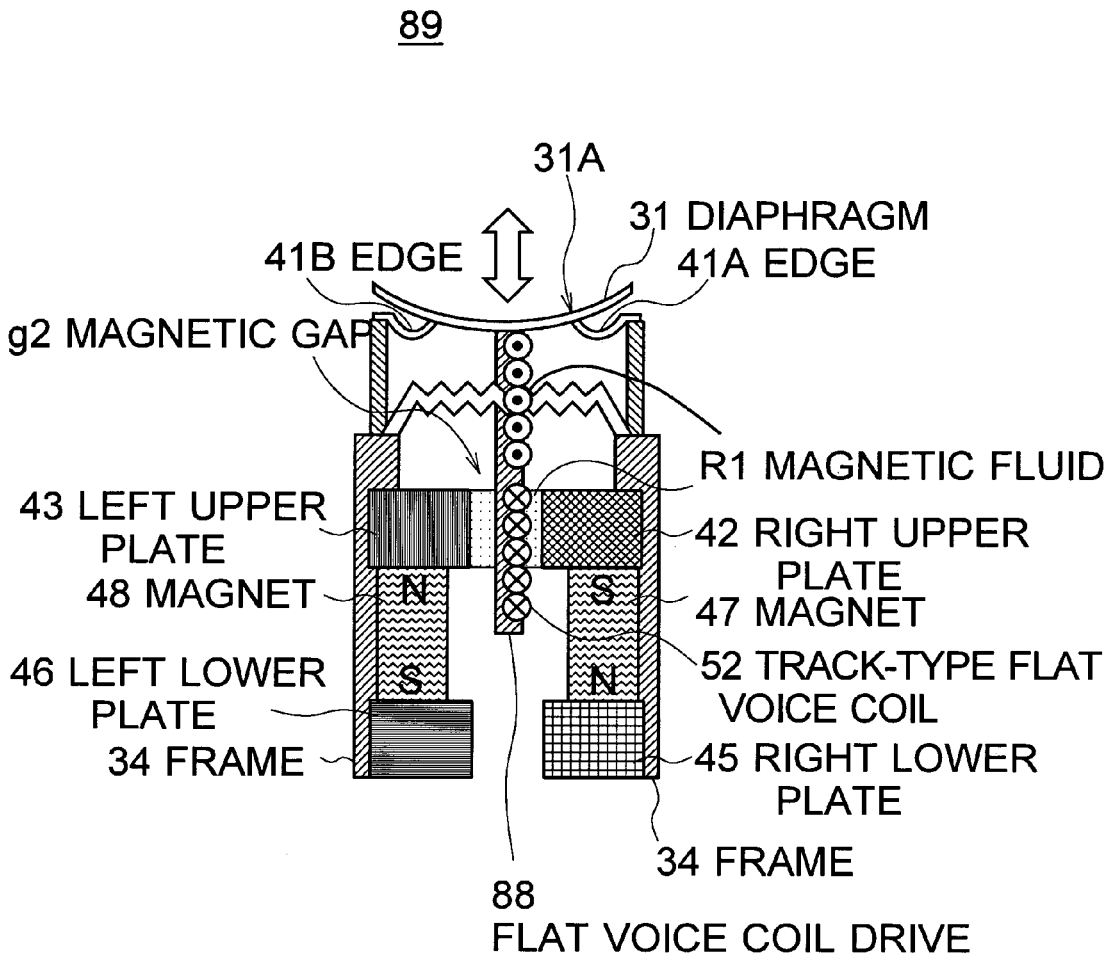
FIG. 26 is a schematic sectional view showing the sectional configuration of a slim-type speaker unit in other embodiment (9)

Further, in the aforementioned embodiment, it has dealt with the case of using the speaker unit 21 (FIG. 7) in that the track-type flat voice coil 52 of the flat voice coil drive 49 is disposed at the almost center of the magnetic gaps g2 and g3, and drive force in the backward and forward direction that the diaphragm 31 vibrates is generated. However, the present invention is not only limited to this but also as shown in FIG. 26 in that the same reference numerals are added to the corresponding parts to FIG. 7, a speaker unit 89 in that a track-type flat voice coil 52 of a flat voice coil drive 88 is disposed only at the almost center of the magnetic gap g2, and drive force in the backward and forward direction that the diaphragm 31 vibrates is generated may be used.

In this case, in the speaker unit 89 (FIG. 26), since it has a structure using only the magnetic gap g2, the length of the flat voice coil drive 88 in the longitudinal direction can be shorter. Thus, the depth of the speaker unit 89 itself can be shortened.

Further, in the aforementioned embodiment, it has dealt with the case of using the twin straight gap magnetic circuit 40 in that as shown in FIGS. 5 and 6, the magnetic gaps g2 and g3 are formed by adhering the right upper plate 42 and the left upper plate 43, and the right lower plate 45 and the left lower plate 46 in an almost L-shape. However, the present invention is not only limited to this but also as shown in FIG. 27A in that the same reference numerals are added to the corresponding parts to FIG. 7, a twin straight gap magnetic circuit 97 in that a right upper plate 91 and a left upper plate 93 in linear form are attached to a frame 34 as separated for a magnetic gap g2 by magnets 47 and 48, and a right lower plate 92 and a left lower plate 94 in linear form are attached to the frame 34 as separated for a magnetic gap g3 by the magnets 47 and 48 may be used.

Figure 27B:
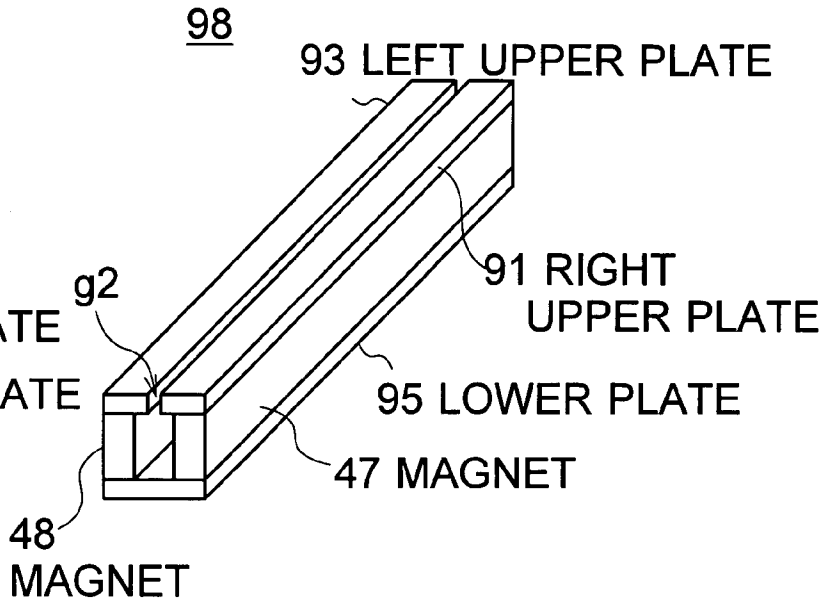
FIGS. 27A and 27B are schematic perspective views showing the configuration of a straight gap magnetic circuit in other embodiment.
Figure 27A:
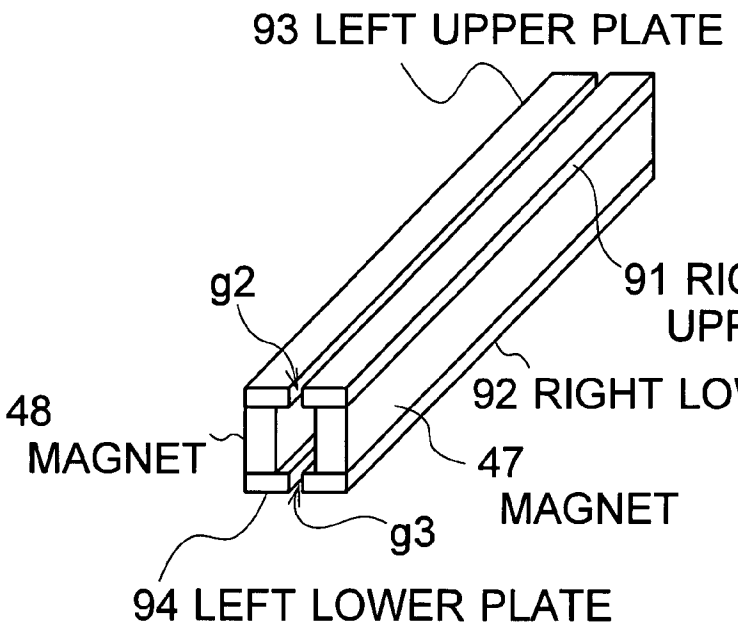

Further, as shown in FIG. 27B, in the speaker unit 21, in place of the twin straight gap magnetic circuit 40, a single straight gap magnetic circuit 98 in that a right upper plate 91 and a left upper plate 93 in linear form are attached to a frame 34 as separated for a magnetic gap g2 by magnets 47 and 48, and a lower plate 95 being a single linear plate is attached to the frame 34 may be used.

Figure 28:
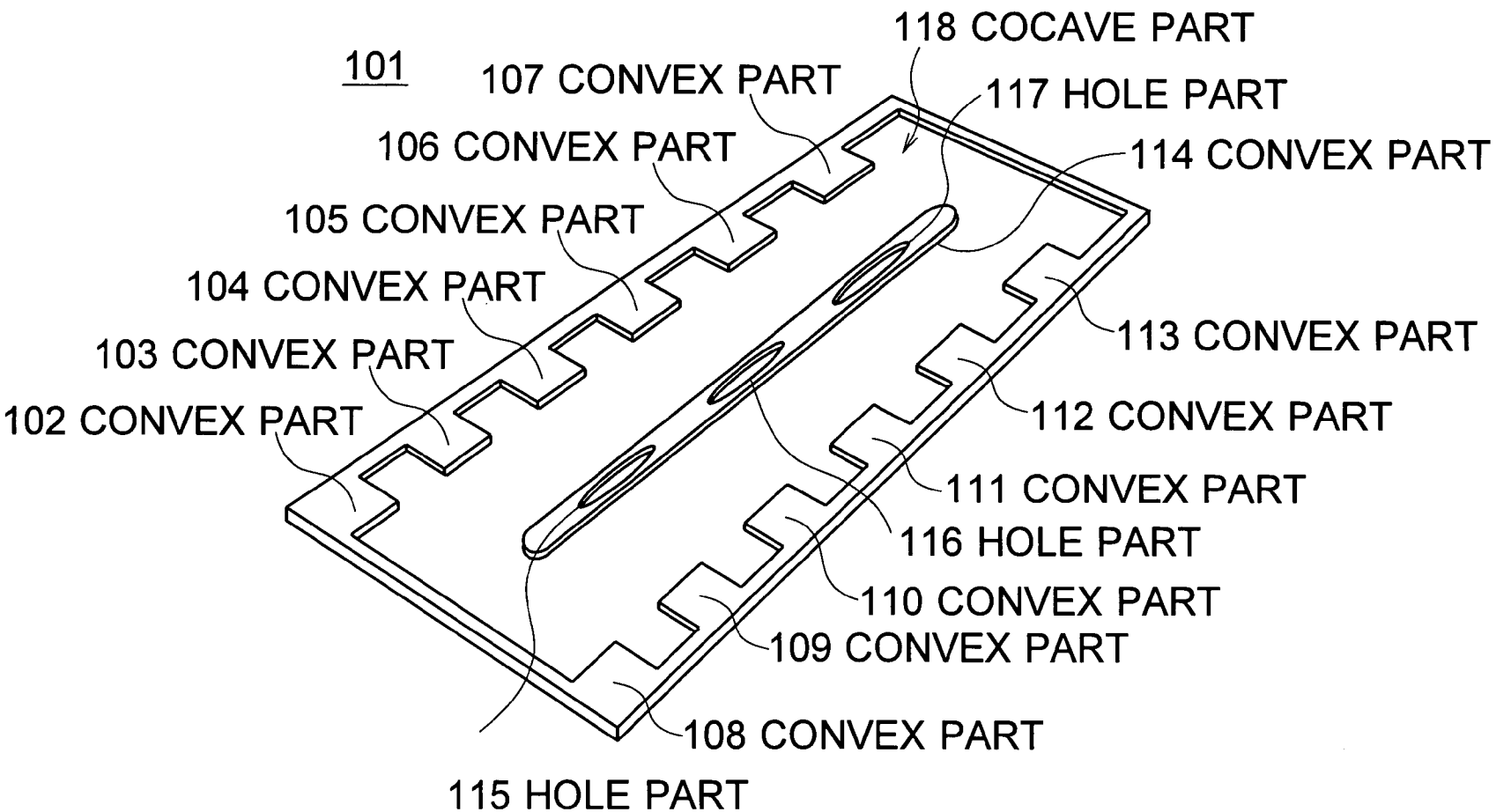
FIG. 28 is a schematic perspective view showing the configuration of a voice coil bobbin in other embodiment.

Further, in the aforementioned embodiment, it has dealt with the case of using the rectangular bobbin 51 shown in FIG. 10. However, the present invention is not only limited to this but also as shown in FIG. 28, a voice coil bobbin 101 having rib structure in that rectangular convex parts 102-113 are formed to a concave part 118, a convex part 114 combined with for positioning at the time of adhering a track-type flat voice coil 52 (not shown), and three hole parts 115-117 on the above convex part 114 are formed may be used.

Further, in the aforementioned embodiment, it has dealt with the case of using the speaker unit 21 having the configuration shown in FIG. 7. However, the present invention is not only limited to this but also a speaker unit having a structure in that a plurality of configurations shown in FIGS. 18-28 are combined may be used.

According to an embodiment of the present invention, the strength of the flat-type voice coil bobbin at the time of driving the diaphragm in the vibrating direction is reinforced by the convex and concave parts, and the diaphragm can be vibrated linearly to drive force. Thus, high quality sounds can be outputted. Therefore, a speaker unit enabling to improve the strength of a voice coil bobbin and sound output in high quality with a simple structure, and a speaker apparatus using that can be realized.

Further, according to an embodiment of the present invention, at the time of driving the diaphragm of the speaker unit stored in the housing in the vibrating direction, the strength of the flat-type voice coil bobbin is reinforced by the convex and concave parts, and the diaphragm can be vibrated linearly to drive force. Thus, high quality sounds can be outputted. Therefore, a speaker apparatus enabling to improve the strength of a voice coil bobbin and sound output in high quality with a simple structure can be realized.

While there has been described in connection with the preferred embodiments of the present invention, it will be obvious to those skilled in the art that various changes, modifications, combinations, sub-combinations and alternations may be aimed, therefore, to cover in the appended claims all such changes and modifications as fall within the true spirit and scope of the present invention.

What is claimed is:

1. A speaker unit comprising:
a magnetic circuit forming a magnetic gap in slit form;
a frame for holding said magnetic circuit;
a diaphragm attached to said frame;
a flat-type voice coil bobbin disposed so as to pass through an almost center of said magnetic gap, and such that a one end of said flat-type voice coil bobbin is in contact with said diaphragm, wherein the flat-type voice coil bobbin comprises:
a central convex part at the almost center of the flat-type voice coil bobbin;
an outer convex part;
a concave part comprising a surface, wherein a voice coil is adhered to the surface; and
a boundary between the outer convex part and the concave part, wherein the voice coil is closer to the central convex part than the boundary; and
a damper attached to said frame to support another end of said flat-type voice coil bobbin.

2. The speaker unit according to claim 1, wherein:
in said flat-type voice coil bobbin, a through hole is formed at a position, the position being on the surface of the concave part and facing to said magnetic gap, and magnetic fluid is enclosed in said magnetic gap.

3. The speaker unit according to claim 1, wherein:
in said flat-type voice coil bobbin, a difference in level of said central convex part and said concave part is smaller than a wire diameter of said voice coil.

4. The speaker unit according to claim 1, wherein:
said diaphragm comprises two projection parts on a back side of said diaphragm, the two projections to be used in positioning one end of said flat-type voice coil bobbin to be in contact with the diaphragm.

5. The speaker unit according to claim 1, wherein;
said damper has a bobbin integrated type configuration with said flat-type voice coil bobbin extended.

6. The speaker unit according to claim 1, wherein:
the boundary is non-linear in a longitudinal direction; and
the boundary is linear in a lateral direction.

7. The speaker unit according to claim 6, wherein:
the boundary in a longitudinal direction is in wave form.

8. The speaker unit according to claim 7, wherein:
the wave form is rectangular.

9. The speaker unit according to claim 1, wherein:
a material from which the flat-type voice coil bobbin is formed is selected from the group consisting of polyimide film, polyarnide nonwoven, a glass polyimide impregnated sheet, aluminum, brass, heat resistant kraft, and a mica sheet.

10. The speaker unit according to claim 2, wherein:
the through hole is one of a plurality of through holes, each of the plurality of through holes overlapping with a part of the voice coil.

11. A speaker apparatus comprising:
a speaker unit comprising:
a magnetic circuit forming a magnetic gap in a slit shape;
a frame for holding said magnetic circuit;
a diaphragm attached to said frame;
a flat-type voice coil bobbin disposed so as to pass through an almost center of said magnetic gap, and such that one end of said flat-type voice coil bobbin is in contact with said diaphragm, wherein the flat-type voice coil bobbin comprises:
a central convex part at the almost center of the flat-type voice coil bobbin;
an outer convex part;

a concave part comprising a surface, wherein a voice coil is adhered to the surface; and a boundary between the outer convex part and the concave part, wherein the voice coil is closer to the central convex part than the boundary; and a damper attached to said frame to support another end of said flat-type voice coil bobbin; and a housing for storing said speaker unit.

12. A flat voice coil drive, comprising:

a voice coil; and a flat-type voice coil bobbin comprising:

a central convex part at the almost center of the flat-type voice coil bobbin;

an outer convex part;

a concave part comprising a surface, wherein a voice coil is adhered to the surface; and a boundary between the outer convex part and the concave part, wherein the voice coil is closer to the central convex part than the boundary.

13. The flat voice coil drive according to claim 12, wherein: in said flat-type voice coil bobbin, a through hole is formed at a position, the position being on the surface of the concave part.

14. The flat voice coil drive according to claim 13, wherein: the through hole is one of a plurality of through holes, each of the plurality of through holes overlapping with a part of the voice coil.

15. The flat voice coil drive according to claim 12, wherein: a difference in level of said central convex part and said concave part is smaller than a wire diameter of said voice coil.

16. The flat voice coil drive according to claim 12, wherein: the boundary is non-linear in a longitudinal direction; and the boundary is linear in a lateral direction.

17. The flat voice coil drive according to claim 12, wherein: the boundary in a longitudinal direction is in wave.

18. The flat voice coil drive according to claim 12, wherein: the wave form is rectangular.

19. The flat voice coil drive according to claim 12, wherein: a material from which the flat-type voice coil bobbin is formed is selected from the group consisting of polyimide film, polyamide nonwoven, a glass polyimide impregnated sheet, aluminum, brass, heat resistant kraft, and a mica sheet.

* * * * *